US005862574A

United States Patent [19]

Poterala

[11] Patent Number: 5,862,574

[45] Date of Patent: Jan. 26, 1999

[54] LOW PROFILE TENTERING SYSTEM AND TENTER FRAME

[76] Inventor: Robert J. Poterala, 140 Rocky Point, Greenville, S.C. 29615

[21] Appl. No.: 881,830

[22] Filed: Jun. 24, 1997

[51] Int. Cl.[6] ..... D06C 3/10

[52] U.S. Cl. ..... 26/89; 26/93; 26/96

[58] Field of Search ..... 26/87, 88, 89, 26/92, 93, 95, 96, 73, 72; 34/660, 662

[56] References Cited

U.S. PATENT DOCUMENTS

| | | | |
|---|---|---|---|
| 1,085,538 | 1/1914 | Burgess et al. . | |
| 2,515,399 | 7/1950 | Dungler | 26/62 |
| 3,073,497 | 1/1963 | Castleton | 26/89 |
| 3,417,444 | 12/1968 | McGreary | 26/96 |
| 3,418,702 | 12/1968 | Coburn | 26/93 |
| 3,469,291 | 9/1969 | Gageur | 26/61 |
| 3,611,479 | 10/1971 | Wicksall | 26/89 |
| 4,134,189 | 1/1979 | Richter | 26/89 |
| 4,679,283 | 7/1987 | Forrest, Jr. | 26/73 |
| 4,877,062 | 10/1989 | Hoefelmayr | 139/294 |
| 4,882,820 | 11/1989 | MacKinnon et al. | 26/93 |
| 4,905,381 | 3/1990 | Poterala | 34/155 |
| 5,005,271 | 4/1991 | Gresens | 26/89 |
| 5,077,965 | 1/1992 | Jedamzik | 26/89 |
| 5,265,313 | 11/1993 | Rutz | 26/73 |
| 5,394,595 | 3/1995 | Rutz | 26/93 |
| 5,613,284 | 3/1997 | Hosmer | 26/93 |

FOREIGN PATENT DOCUMENTS

| | | | |
|---|---|---|---|
| 4118504 | 12/1992 | Germany | 26/89 |

*Primary Examiner*—Amy B. Vanatta
*Attorney, Agent, or Firm*—Robert R. Reed; Cort Flint

[57] ABSTRACT

A new low-profile tentering system for a tenter machine is realized according to the present invention by a tenter frame including low-profile rail assemblies for carrying an endless carrier. A series of attachment blocks of the endless carrier have tentering connectors to provide for transporting a sheet material under widthwise tension in a longitudinal path through the tenter machine.

Each rail assembly has guideways for supporting and carrying an endless carrier within the guideways. The tentering system of this invention uniquely uses a plurality spherical bearing balls for transporting the endless carrier within slots of the guideways. The endless carrier includes an endless belt or endless chain connecting a series of attachment blocks for holding the bearing balls in a position so that they can freely rotate within the guideways. Tentering connectors are carried by the attachment blocks of the endless carrier for supporting spaced apart edges of the sheet material. The endless carrier is driven by spaced drive wheels in a closed-loop path to carry the sheet material along the longitudinal path through the tenter machine. A transition guideway section, formed with a plurality of adjacent bending contour plates, provides for angular transitions when connecting together entry, stretch, intermediate and delivery guideways of rail assemblies. A vertically operated closed-loop endless carrier driven by vertical drive wheels, is also within the scope of this invention.

53 Claims, 10 Drawing Sheets

Fig. 4
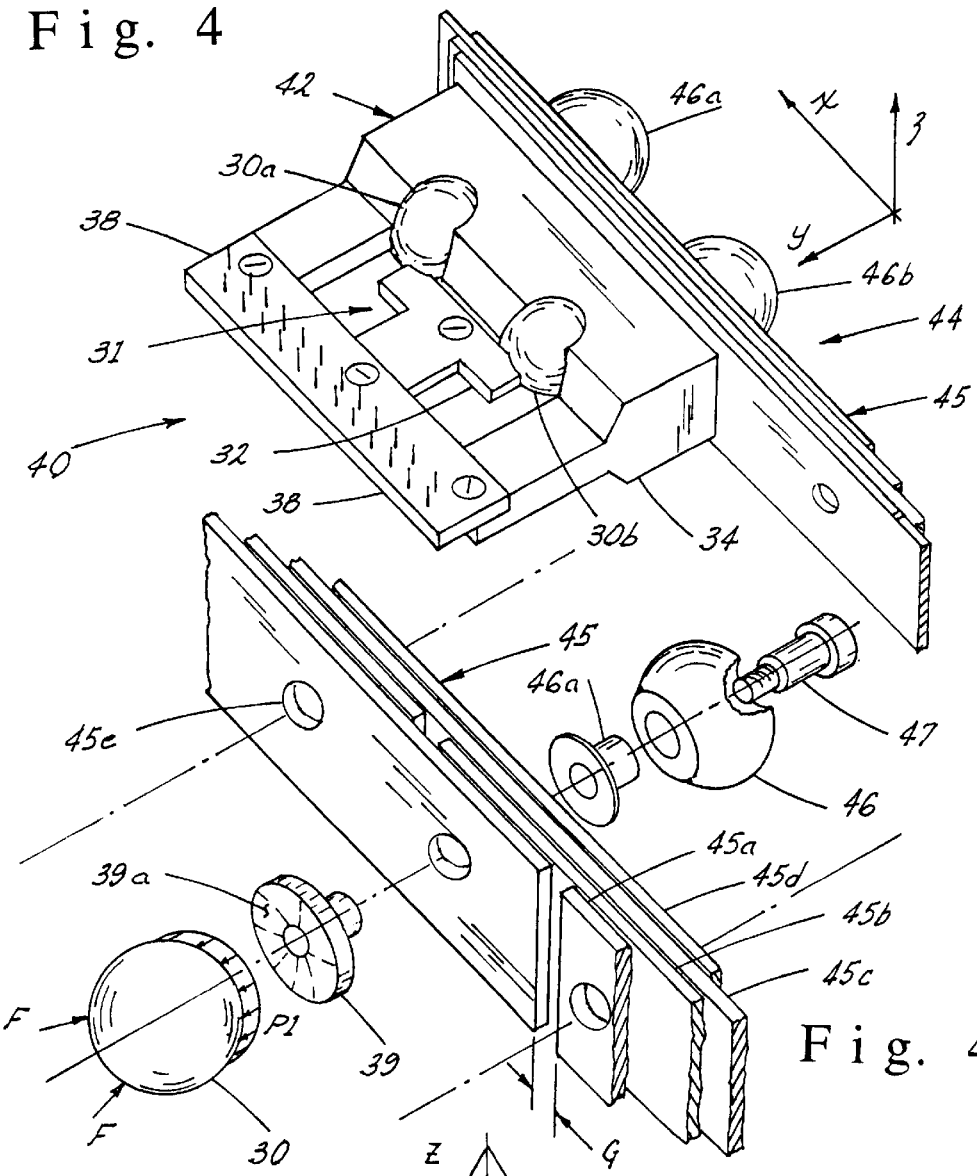
Fig. 4A
Fig. 5
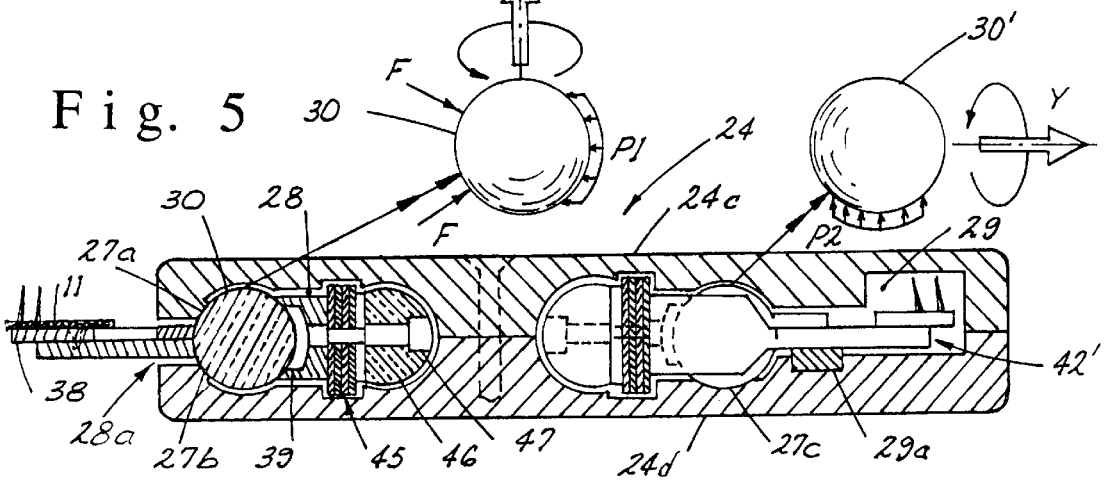

Fig. 14
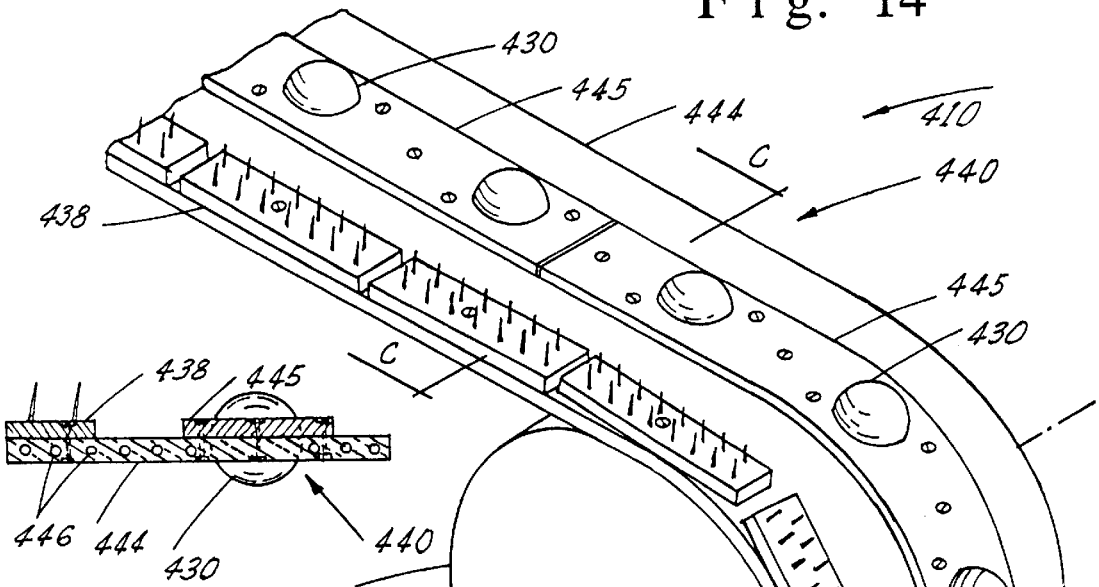
Fig. 14A
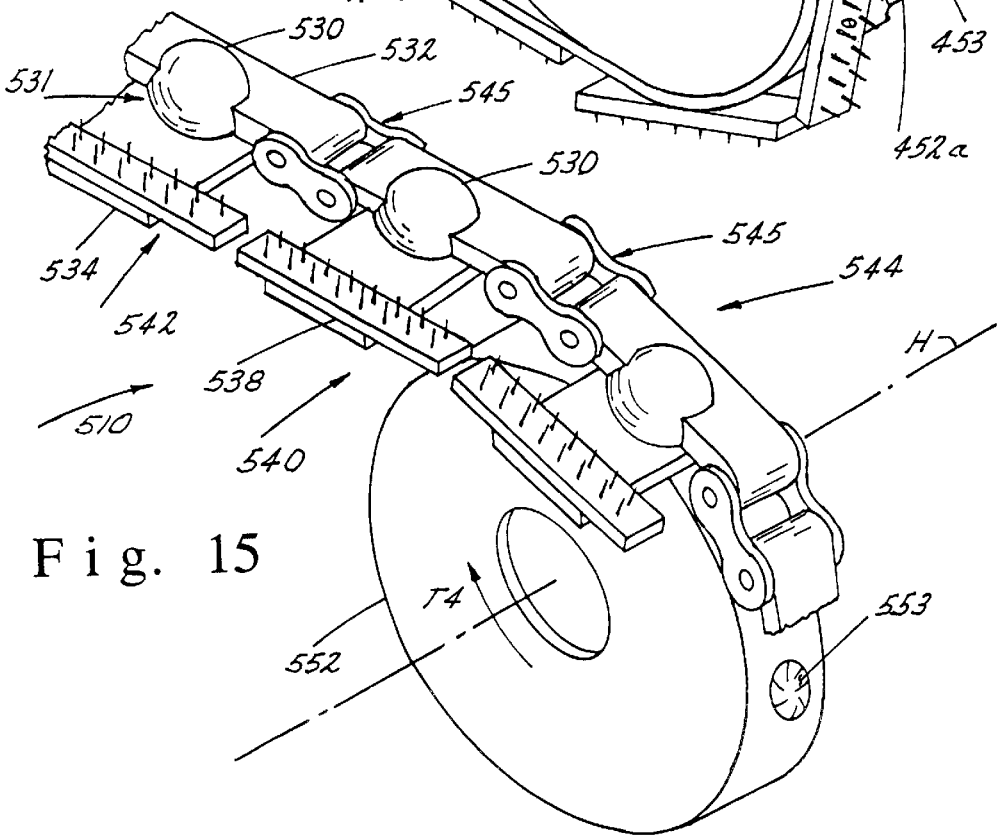
Fig. 15

LOW PROFILE TENTERING SYSTEM AND TENTER FRAME

BACKGROUND OF THE INVENTION

This invention relates to a tenter machine, and more particularly to a low profile tentering system, including chain and rail designs for compact tenter machine applications.

Generally speaking a tenter machine is an open-width fabric-finishing machine in which the selvedges of a woven textile fabric or sheet material are held by a pair of endless traveling carriers in an open width condition while maintaining widthwise tension in the fabric or sheet. For example, tension is maintained in the weft yarns of a fabric. Selvedges are held by a tentering system or tenter frame. Tentering connectors include pin tenters or tentering clips. Other materials having a thin film web can also be tentered. Such tenter machines are used for drying fabric, for heat setting of thermoplastic material, for fixation of chemical finishes and the like.

A typical dryer oven for a compact tenter machine is disclosed in U.S. Pat. No. 4,905,381. The compact dryer oven of this reference is heat efficient and includes a lower housing and an upper housing for providing a short air distribution path and air recycle time. For efficient operation, this dryer oven needs a low-profile tentering system so that proper temperatures can be maintained between the upper and lower housings for fast drying. A clean and efficient tentering system is required to smoothly transport the material through the dryer as it is being held under tension along its selvedges by the tentering system. A low maintenance and low rate of wear tentering system is required for a continuous operation of a tenter machine; typical of a compact tenter machine for drying an endless sheet of material.

A tentering system or tenter frame is used for transporting the sheet material along a longitudinal tentering path. Components of the tentering system include means for driving an endless chain or carrier along the longitudinal path and returning the chain to the start of the longitudinal path. The endless chain forms a closed-loop path and it must be supported along this closed-loop path by tentering rails adjacent the selvedges of the sheet material. The selvedges are held and transported by pins or clip edges of the tentering connectors. A compact tentering system which freely moves the endless chain along the tentering rails with less need for lubrication is most desirable for low wear energy efficient operation and for keeping the sheet material clean.

Typical endless chains forming a closed-loop path for transporting a fabric or sheet material are disclosed in U.S. Pat. Nos. 4,134,189; 4,679,283; 4,877,062; 4,882,820; and 5,265,313. In general, the endless chains are a series of attachment elements or blocks driven by a drive sprocket or wheel for transporting a sheet material under tension along a longitudinal path. Generally speaking, the endless chains of these references require complex bearing assemblies for supporting the chain in a rail assembly. The chains also have a need for lubrication to reduce wear and make the endless chain move freely.

The endless chains are carried by a rail assembly along the closed-loop path. Examples of rail assemblies known in the art are disclosed in U.S. Pat. Nos. 3,469,291; 4,679,283; and 4,882,820. The endless chain moves along or within the rail assembly being supported by the rail assembly itself. In general the rail assemblies of these references require an overall space having a vertical and/or horizontal dimension larger than the space available in the compact tenter machine.

The four U.S. Pat. Nos. 3,469,291; 4,134,189; 4,679,283; and 5,265,313 disclose endless tentering chains with ball bearings that interface with rail assemblies. Each reference discloses an endless chain component comprising a series of anti-friction cylindrical rollers to react the horizontal loads from the sheet material under tension to the rail assemblies. Additional cylindrical rollers or ball bearings are provided for reacting vertical loads from the chain to the rail assemblies, including the weight of the endless chain. The small steel balls within the ball bearings require frequent lubrication to reduce wear on the bearings.

The disclosure of U.S. Pat. No. 4,679,283 illustrates a series of carriers or attachment blocks having cone shaped drivers or roller elements in contact with contacting rails of stationary carrier supports. The attachment blocks are connected together and driven by a drive chain. The stationary carrier supports serve as a tentering rail to include the contact rails on which roller elements move. However, the cone shaped roller elements contact the contact rails over a small area to react horizontal and vertical loads from the carriers to the carrier supports; resulting in a potential for high wear rates.

In U.S. Pat. No. 2,515,399 the ball bearings are also conical to form both a guiding and supporting means for the endless chain. The V-shaped periphery of the ball bearing slides as it rolls along a track of the tentering rail. Once again, the small steel balls within the ball bearings require frequent lubrication to reduce wear on the bearings.

An alternate method of reacting loads from an endless tentering chain to guide rails of a tenter frame is disclosed in U.S. Pat. No. 4,882,820. Slide blocks and slide plates are inserted in the guide rails that interface with the endless chain and support the chain as it moves along the guide rails. The blocks and plates are selected to provide low friction and reduced wear at sliding interfaces. This design depends on a use of materials having a low coefficient of friction during sliding contact so that the endless chain will not become bound by misalignment within the guide rails.

Means for linking the individual components or blocks of the chain together are illustrated in U.S. Pat. Nos. 1,085,538; 4,877,062; and 4,882,820. In U.S. Pat. No. 1,085,538 the individual links have a ball and socket arrangement for connecting the links together. In U.S. Pat. No. 4,877,062 block members are interconnected with a guide means to move the block members along guide rails of the tentering system. U.S. Pat. No. 4,882,820 discloses an endless chain with linking elements comprising slide plates, shoe plates and support plates. These references in general have numerous or complex linking elements linked together.

Tentering clips or pin tenters that grip and support the selvedges of the sheet material are disclosed in U.S. Pat. Nos. 2,515,399; 3,469,291; 4,134,189; and 4,882,820. The tentering clips generally have a vertical dimension which requires a typical compact dryer oven, such as that disclosed above (U.S. Pat. No. 4,905,381), to operate with less efficiency.

The provision of a suitable tentering system having a low-profile rail assembly and an endless carrier remains for compact tenter machines. This is a problem which needs considerable attention. The problem generally exists with providing a low-profile tentering system requiring less lubrication for smooth operation, having low friction load bearing assemblies, requiring less maintenance and having lower wear rates. For example, the low-profile is required to operate a compact dryer oven for drying, heat setting and fixation without relatively large amounts of energy being provided. Tentering clips of the art are also too large to be transported in a low-profile rail assembly. This problem is characterized by the space distribution of the drying energy making it difficult to control the temperature at the faces of the fabric or sheet material. A low-profile endless carrier within a low-profile rail assembly is needed.

Another need exists to define proper use of materials for the rail assemblies and the endless carriers so that bearing assemblies provide interfaces for contacting elements to easily move with respect to one another. A low friction environment is critical for the proper movement of the endless carrier within the rail assemblies, while controlling wear and limiting the use of lubricants to provide a clean environment for the sheet material.

The references do not solve the problems associated with a low-profile tentering system for an energy efficient compact tenter machine. Generally speaking, the references use ball bearings which interface with both horizontal and vertical surfaces within a rail assembly. None of the references disclose an endless tentering chain with bearing assemblies for supporting the bearings to rotate about orthogonal axes to react to both horizontal and vertical loads to the rail assembly. The chains of the art are designed to be made with rigid structural components linked together to form endless chains. The art does not utilize belts or thin metallic straps which can be made into flexible bands for connecting tentering connectors together as an endless belt.

Accordingly, an object of the present invention is to provide a low-profile tentering system or frame for a compact tenter machine and the like.

Another object of the present invention is to provide a tentering system for a tenter machine with attachment blocks having low friction spherical bearing balls that rotate about orthogonal axes for supporting the attachment blocks as they travel on or within rail assemblies.

Yet another object of the present invention is to provide an endless belt or chain interconnecting attachment blocks of a endless carrier having increased flexibility and reliability.

A further object of the invention is to provide connecting guideways of the rail assemblies of a tentering system for guiding an endless carrier having a small angular change in direction along its longitudinal path so that the sheet material is transported from one guideway to the next.

An additional object of the present invention is to provide an endless carrier having improved drive components so that the endless carrier can be driven along a closed-loop path in a horizontal or a vertical plane.

In still another object of the invention the rail assemblies and endless carriers of the tentering system have components made of a material so that rolling and sliding interfaces have low friction and low wear rates.

SUMMARY OF THE INVENTION

The above objectives are accomplished according to the present invention by providing a low-profile tentering system for transporting sheet material under tension in an open width condition along a longitudinal path. The tentering system includes spaced, low-profile rail assemblies supported on opposing sides of the longitudinal path. An endless carrier is carried by each the rail assembly for conveying the sheet material along the longitudinal path. The rail assemblies have guideways for carrying the endless carrier along the longitudinal path. A plurality of low-profile attachment blocks are included in the endless carrier for holding spaced edges of the sheet material under tension. Spaced drive wheels are associated with the rail assemblies for moving the endless carrier along a closed-loop path which includes the longitudinal path. Bearing assemblies are included in the low-profile attachment blocks having at least one bearing ball being operative to engage the guideways to allow the endless carrier to move along the guideways in a controlled, guided and substantially restraint-free manner.

In an advantageous form of the invention, the guideways include internal engagement shoulders, and the bearing assemblies of the attachment blocks have a ball retainer rotatably retaining the bearing ball as the bearing ball engages the engagement shoulders. Preferably, the guideways include pathway slots machined into the rails receiving the endless carrier within the guideways. The pathway slots have longitudinal side openings. The engagement shoulders are defined on opposing sides of the side opening, and a flange of the attachment blocks extends through the side opening between the engagement shoulders to support the tentering connector. Advantageously, the guideways comprise a delivery pathway slot and a return pathway slot by which the bearing balls are guided. The delivery pathway slot includes a pair of vertically spaced forward engagement shoulders, the engagement shoulders providing a running surface for the bearing balls of opposing endless carriers during transport of the sheet material in the open width tension along the longitudinal path. The delivery pathway slot may include a rear engagement shoulder spaced rearwardly from the forward engaging shoulders providing a top running surface which interfaces with the endless carrier during transport of the sheet material to help maintain the sheet material in the open width condition. A return bushing is carried in the return pathway slot for contacting the endless carrier to further position and support the endless carrier within the return pathway slot. The return pathway slot also may include a return engagement shoulder for engaging the bearing ball to help position the endless carrier within the return pathway slot, and the return shoulder provides a running surface for the bearing balls which vertically supports the endless carrier. Preferably, the guideways include an upper longitudinal rail section and a lower longitudinal rail section joined together to form the pathway slot internally for guiding the endless carrier.

The system includes a plurality of transition guideway sections for interconnecting adjacent ones of the guideways at desired junctions along the longitudinal path to provide for a change in the direction of the longitudinal path formed by the adjacent guideways. The transition sections include a series of adjacent plates fastened together, and the plates having contours which correspond to the change of direction. The series of plates are fastened together in a juxtaposed arrangement having horizontal edges vertically spaced apart to define the pathway slots therethrough.

The spaced drive wheels may be vertically disposed to rotate about a horizontal axis for transporting the endless carrier along its closed-loop path through the guideways in a vertical plane. The endless carrier may include a molded belt portion and a flexible metallic strap for retaining the bearing balls to engage contoured sprocket cavities of the drive wheels for driving the endless carrier.

In an advantageous form of the invention, the endless carrier includes a plurality of longitudinal straps secured together in a laminated overlapping manner to form an endless strap belt. The strap belt carries a series of the attachment blocks on one side and a series of driving elements on an opposite side which engage the spaced drive wheels. The spaced drive wheels have circumferentially arranged sprocket cavities, and the drive elements include a plurality of contoured drive elements are arranged along the endless carrier in spaced apart positions to engage the sprocket cavities. Connecting members rotatably affix the drive elements to a first side of the endless belt and secure the attachment blocks to a second side of the endless belt. The connecting members include: roller bushings carried within the attachment blocks for holding the bearing ball adjacent the second side of the endless belt; and connector pins for connecting the drive elements on the first side of the endless belt with the roller bushings through the endless belt. Strap spaces are formed between the laminated overlapping straps to provide flexibility to the strap belt when it bends. The longitudinal straps further include oversized slotted holes which are partially aligned from strap to strap receiving the connector members so that the straps are slidably held together to form the flexible endless belt having flexibility to bend in a plane perpendicular to the longitudinal direction.

In another advantageous form of the invention, a plurality of linking elements connect the attachment blocks together as links to form an endless link belt. The attachment blocks include linking tabs, and connecting pins connecting the linking tabs of adjacent attachment blocks for forming the endless chain belt. Preferably, the attachment blocks include a base portion having a spherically shaped cutout for retaining the bearing ball and an upper portion also having a spherically shaped cutout for retaining the bearing ball. The linking tabs are carried by the upper and lower block portions. The linking tabs of adjacent attachment blocks overlap one another to form rotating joints of the endless chain belt.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 4 is a perspective view of an attachment block and drive spheres adjacent longitudinal extending straps of an endless belt of the endless carrier of the preferred low-profile tentering chain assembly of FIG. 3;

FIG. 4A is an exploded perspective view showing the drive sphere and connecting members of the endless belt of FIG. 4 for connecting and driving the longitudinal extending straps as a preferred endless carrier so that a roller bushing interfaces with a bearing ball;

FIG. 5 is a cross-sectional view of a preferred guideway of the rail assemblies showing an endless carrier within a tentering pathway slot on one side and within a return pathway slot on the other lateral side, of the guideway, as respective spherical bearing balls rotate about orthogonal axes in the respective slots;

FIG. 14 is a perspective view of a vertical embodiment of a low-profile tentering chain assembly illustrating the endless carrier being looped in a vertical plane and driven by a vertically disposed drive wheel;

FIG. 14A is a cross-sectional view of the endless carrier of FIG. 14 showing a reinforced molded belt portion supporting a pin tenter; and FIG. 15 is a perspective view of a further vertical embodiment of a low-profile tentering system according to the invention.

DESCRIPTION OF A PREFERRED EMBODIMENT

Figure 1:
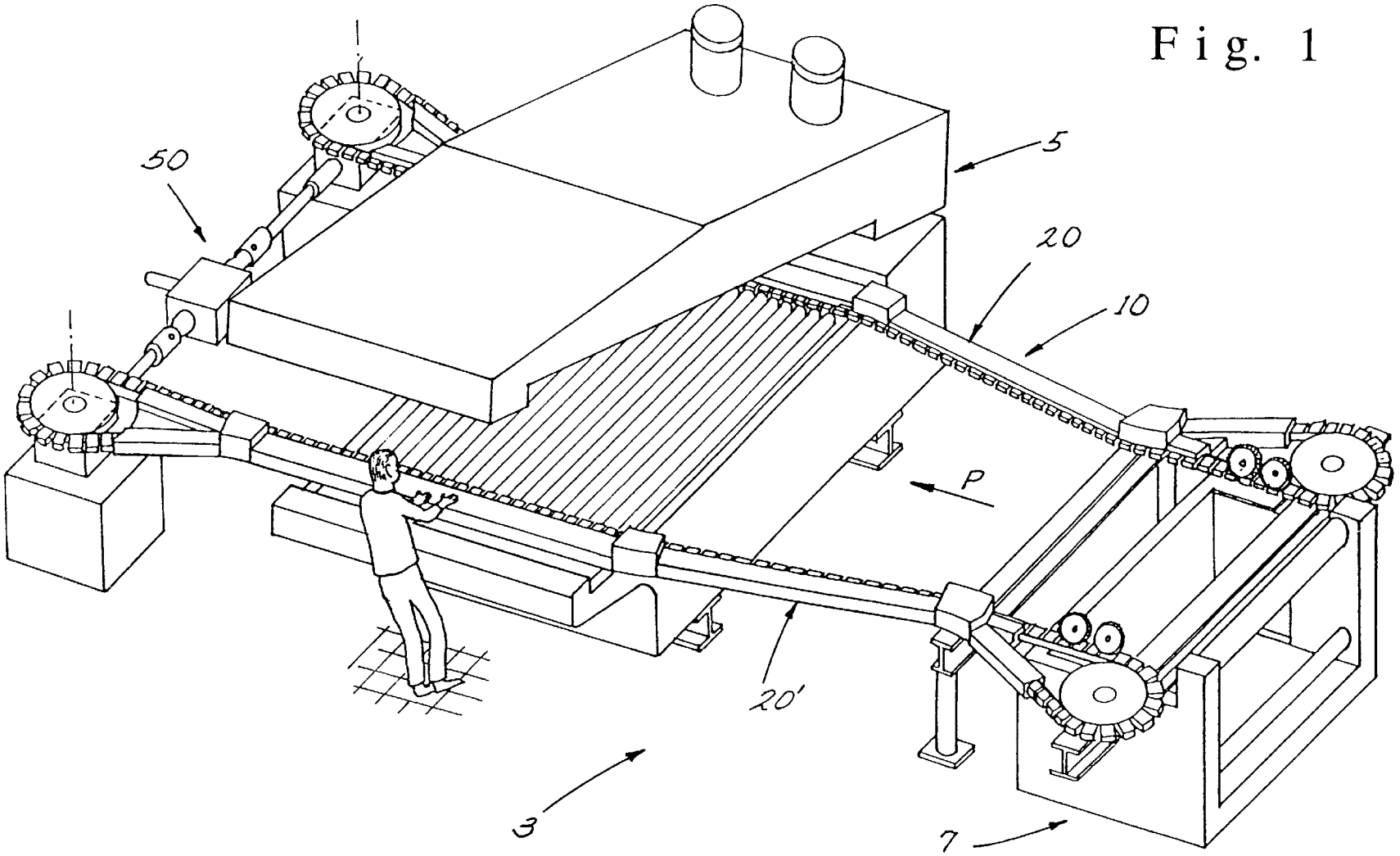
FIG. 1 is a perspective view illustrating a low-profile tenter machine incorporating a tentering system constructed in accordance with the present invention.

Referring now in more detail to the drawings, the invention will now be described in more detail. The tentering system is for general use with a tenter machine having various applications. The application of FIG. 1 illustrates the tentering system, designated generally as 10, included in a tenter machine, designated generally as 3, to be used for stretching and drying of a sheet material (not shown). An entry feed system 7 is provided for starting the operation and drying by a compact dryer oven 5. A drive system 50 provides the means for transporting the sheet material along a longitudinal path P through the tenter machine and oven.

Figure 2:
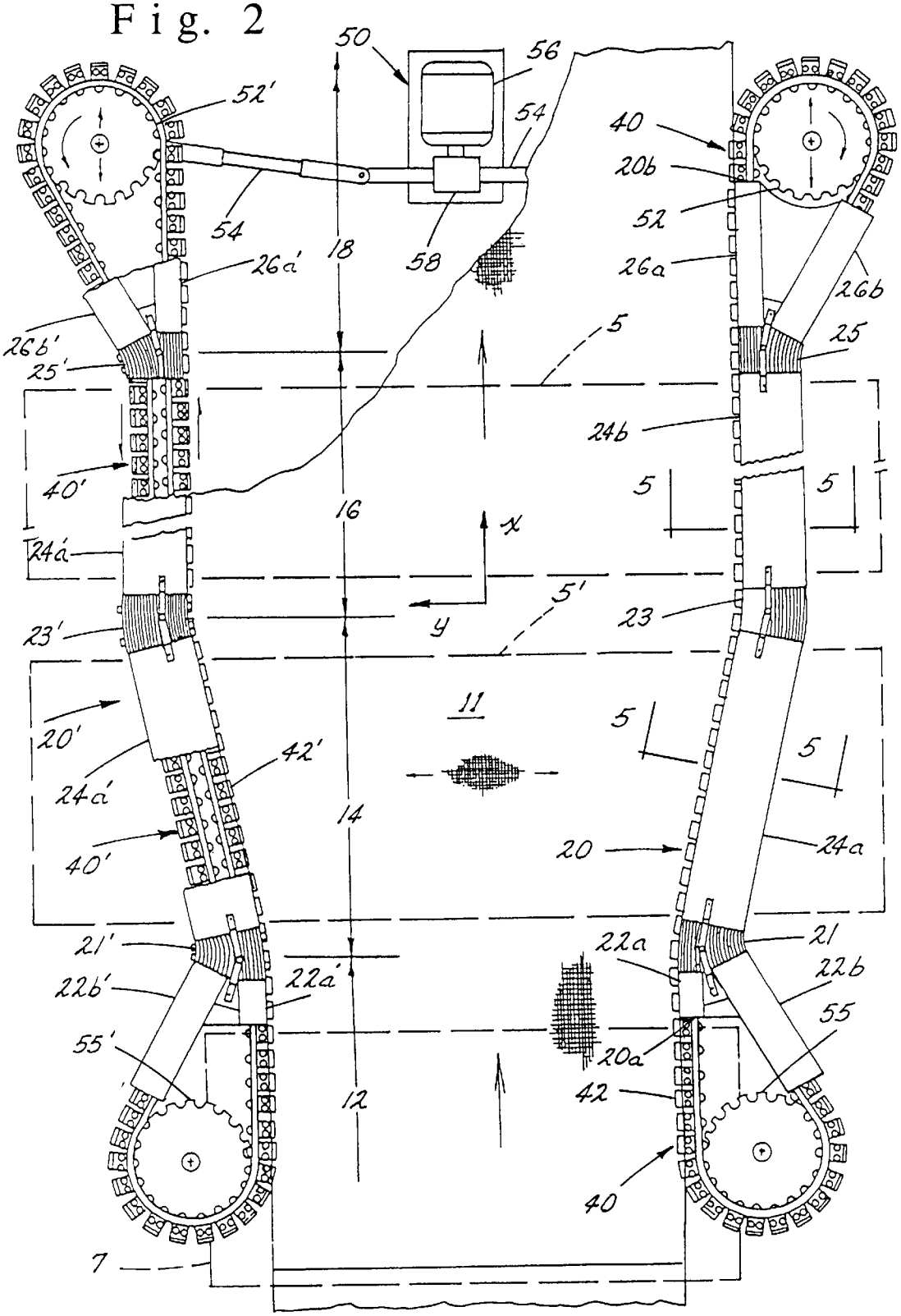
FIG. 2 is a top plan view of the tentering system for a tenter machine according to the invention.

A plan view of a sheet material 11 being transported by the tentering system is illustrated in FIG. 2. In an entry section 12 of the tentering system, a fabric web or thin sheet material (herein referred to as sheet material) is fed into entry feed system 7. The sheet material 11 is under tension in an open width between spaced rail assemblies 20 and 20'. The sheet material is gripped along its selvedges by attachment blocks 42 and 42' of endless carriers 40 and 40. Endless carriers 40 and 40' are carried by guideways of the rail assemblies of tentering system 10. The sheet material is transported through the tenter machine in the longitudinal x-direction. A typical entry feed system is described in U.S. Pat. No. 4,817,254. The disclosure of U.S. '254 is made a part of this description by reference thereto.

The tentering system or tenter frame is generally divided into two mirror image portions for gripping the sheet material 11 along its selvedges, as illustrated in FIGS. 1 and 2. Reference to the tentering system in this description and in the drawings refers to endless carrier and rail assembly components along either or both lateral sides of tenter machine 3. A stretch section 14 of the tentering system, in a direction traveling away from the entry feed system being the positive x-direction, has diverging or stretch guideways 24*a* and 24*a'* which diverge in the lateral y-direction. This divergence essentially stretches sheet material 11 as it travels along this stretch section 14.

An intermediate section 16 of the tentering system following the stretch section (FIG. 2) has a generally constant width for further treatment of the sheet material. For example, a compact dryer oven 5 is illustrated in FIGS. 1 and 2 for drying sheet material 11 as it travels through the intermediate section of the tenter machine. A typical compact dryer oven is disclosed in U.S. Pat. No. 4,905,381. The description of the dryer oven in U.S. '381 is included herein by reference thereto. A single oven or a series of ovens (or other units) can be used as needed for treatment of the sheet material within intermediate section 16. A length and a width of the intermediate section can be adjusted to provide the number of ovens or other treatment units required for proper conditioning of the sheet material. Ovens or other treatment units can also be used in the stretch section of tenter machine 3 as desired.

A delivery section 18 of the tentering system of the tenter machine follows the intermediate section, as illustrated in FIG. 2. The delivery section also has a generally constant width over its x-direction length. A tenter drive system 50 has a motor 56 for rotating drive shafts 52 to activate tenter system 10, as illustrated in FIGS. 1 and 2. The drive shafts rotate drive wheels 52 to move each endless carrier 40 and 40' through guideways of rail assemblies 20 and 20'. Attachment blocks 42 are interconnected by an endless belt or chain 44 that loops around driven drive wheels 52 and entry drive wheels 55 in an endless closed-loop path. Attachment blocks 42, being to one side of endless belt or chain 44 of tentering system 10, attach to the selvedges of sheet material 11 and transport the sheet material under tension through tenter machine 3.

Drive system 50 includes a gear box 58 to help control the speed of the sheet material through the tenter machine, as illustrated in FIG. 2. Drive shafts 54 are articulated so that driven drive wheels 52 can be moved in the x-direction, as shown by the arrows, for controlling the amount of tension in endless carriers 40 and 40'.

Rail assemblies 20 and 20' include a series of guideways, as illustrate in FIG. 2. Stretch guideways 24*a* and 24*a'* and intermediate guideways 24*b* and 24*b'* can be essentially the same design. Entry guideways 22*a*, 22*a'* and delivery guideways 26*a*, 26*a'* are divided guideways for providing for a separation of the endless carrier to negotiate drive wheels 55 and 52 respectively. Entry return guideways 22*b*, 22*b'* and delivery return guideways 26*b*, 26*b'* result from this division. Transition guideway sections 21, 23 and 25 interconnect other guideways for providing a smooth travel of the endless carrier from one guideway to the next through a small horizontal angle change in the xy-plane. The guideways carry the endless carrier during its tentering function, positive x-direction movement, as well as during its return, negative x-direction movement. That is, changes in direction of endless carriers 40 and 40' in the closed-loop path are provided by drive wheels 52 and 55 and transition guideway sections 21, 23 and 25 of rail assemblies 20 and 20'. Further details of rail assemblies 20 and 20' as well as endless carriers 40 and 40' are discussed in the sections to follow.

Figure 3:
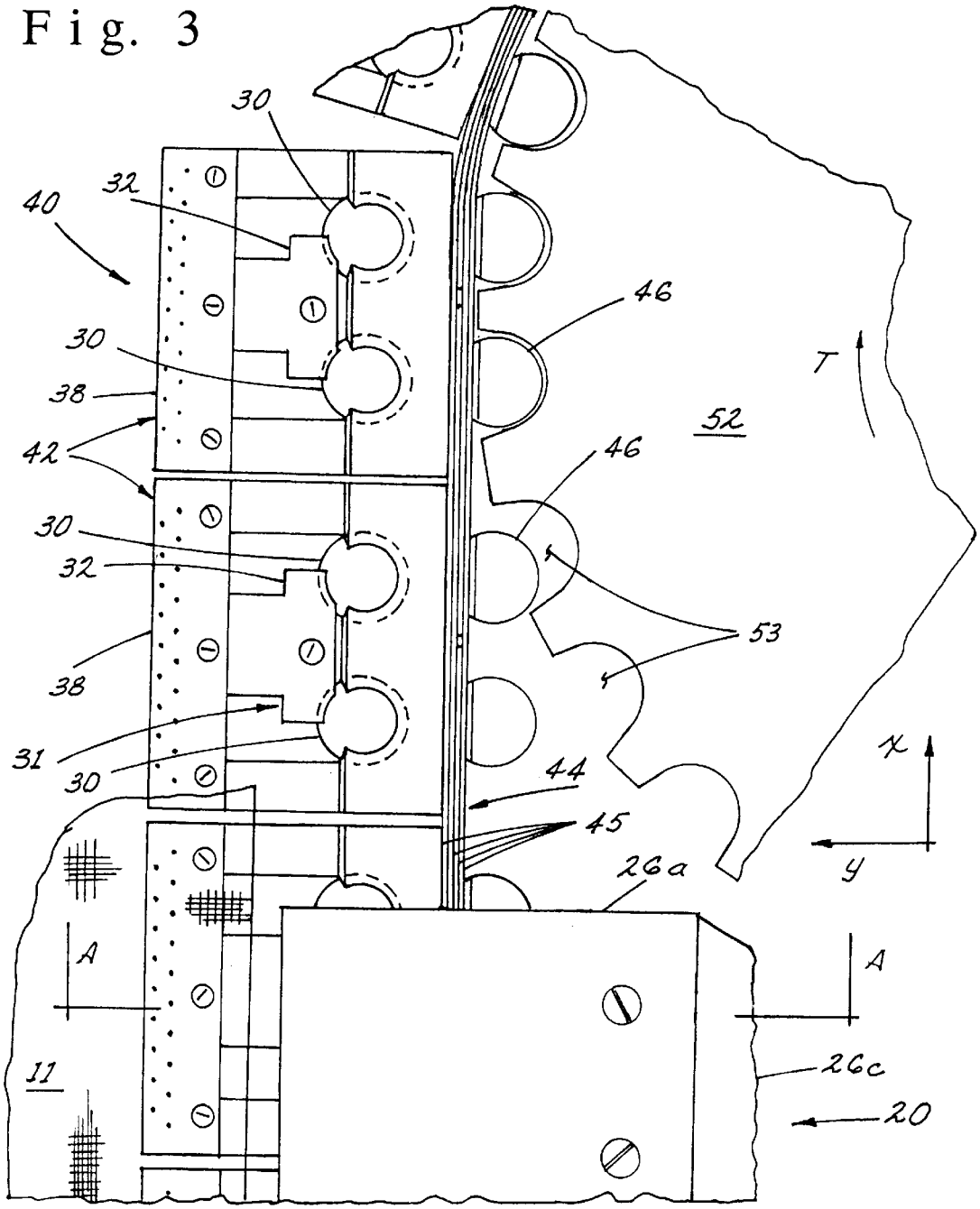
FIG. 3 is an enlarged top plan view of a preferred low-profile endless carrier as it leaves a delivery guideway of a rail assembly to become engaged by a drive wheel of tentering system of the invention.

An endless carrier 40 exiting from a delivery guideway 26 of a rail assembly 20 to be engaged by a drive wheel 52 is illustrated in FIG. 3. A plurality of contoured drive elements or drive spheres 46 of this preferred endless carrier engage contoured sprocket cavities 53 to pull the endless carrier through the rail assembly when a torque T is applied to drive wheel 52 by the drive system (FIG. 2). A sheet material 11 is attached to a series of low-profile attachment blocks 42 using pin tenters 38 and is thereby carried along its longitudinal x-direction path. Pin tenters are commonly made with a brass base having stainless steel pins extending from the base. The attachment blocks are arranged side by side on one side of an endless belt 44. Contoured drive elements 46 are equally spaced apart on the other side of the endless belt. The endless belt of the preferred embodiment includes a plurality of longitudinal extending straps 45 slidably connected together. The contoured drive elements are interconnected with the attachment blocks through endless belt 44. The attachment blocks are transported along their path by the endless belt which is being driven by drive wheel 52 contacting contoured drive elements 46 and deforming itself around drive wheel 52. Longitudinal extending strap 45 is formed by overlapping a plurality of thin metallic straps 45*a*–45*d* (FIGS. 4 and 4A).

Figure 3A:
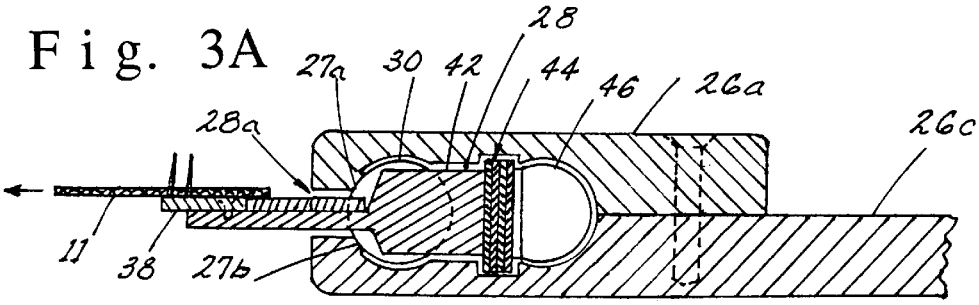
FIG. 3A is a cross-sectional view taken along line A—A in FIG. 3.

Details of attachment blocks 42 being housed and transported within delivery rail 26*a* of rail assembly 20 is illustrated in FIGS. 3 and 3A. A cross-sectional view taken along line A—A of FIG. 3 is shown in FIG. 3A. The preferred attachment blocks include a bearing assembly 31 having a pair of bearing balls 30 (30*a* and 30*b*) and a ball retainer 32 to retain the bearing balls so that they are free to rotate about any axes. A delivery guideway 26*a* of rail assembly 20 has a delivery pathway slot 28 to house the attachment blocks extending from a longitudinal side opening 28*a* to carry a pin tenter 38 to engage sheet material 11 being transported. Bearing balls 30 contact upper and lower interface shoulders 27*a* and 27*b* of the delivery guideway within the tentering pathway slot to react the forces from sheet material 11 and from the weight of endless carrier 40 itself. The endless carrier exits outlet end 20*b* of delivery guideway 26 of rail assembly 20. The delivery guideway is made in two sections 26*a*, 26*b* for ease in forming tentering pathway slot 28 and for assembling the guideway. Bottom section 26*c* of the delivery guideway extends laterally to the other side of drive wheel 52 to combine with another top section to provide a return pathway slot (not shown).

Further details of the structure and function of endless carrier 40, as illustrated in FIGS. 4 and 4A, are disclosed herewith. A block base or base portion 34 of each attachment block 42 carries bearing assembly 31. The base portion helps retain the spherical bearing balls 30*a* and 30*b* and carries a pin tenter 38. The bearing balls are also retained within the base portion by a ball retainer 32 of the bearing assembly. Endless belt 44 comprises a longitudinally extending strap 45 made from a plurality of lapping thin metallic straps 45*a*–45*d*. The straps are similar to a commercial band-saw in size and type of material used. Oversized slotted holes or strap slots 45*e* are provided in each strap for forming the straps together in an overlapping manner to provide an endless belt 44, as illustrated in FIG. 4A. The endless belt is to be flexible bend in a plane perpendicular to its longitudinal direction when deformed.

Flexible endless belt 44, contoured drive elements 46 and base portion 34 are connected together by a connecting pin 47 extending through each drive sphere and the respective strap slot for attachment to a respective roller bushing 39. Each roller bushing is carried by an attachment block and forms a nut for the connecting pin. The roller bushing has a contact surface 39*a* which forms a sliding interface with bearing ball 30 when the bearing ball rotates within the attachment block. Contoured drive elements 46 are free to rotate about the connecting pin 47 and the roller bushing is imbedded in base portion 34 to hold it connected with flexible endless belt 44. A drive bushing 46*a* is provided between the drive sphere and the endless belt for enhancing the ability of the drive sphere to rotate about the connecting pin, and to provide a washer for the oversized slotted holes 45*e* in flexible endless belt 44.

Each individual longitudinally extending metallic strap 45*a*, 45*b*, 45*c* or 45*d* of endless belt strap 45 has a plurality of slots 45*e* which are oversized holes elongated along a length of the endless belt strap to allow for movement of the straps with respect to connecting pin 47 and base portion 34. The slots of longitudinal extending straps 45*a*–45*d* align with each other when the belt is straight. This is necessary for the belt to be able to turn through an angle when forming itself around a drive wheel (FIG. 2). The preferred thin metallic straps are made of a hard stainless steel with dimensions in a range of about 1 inch to about 1.5 inches wide, about 10 feet to about 20 feet long and having a thickness of about 0.10 inch to about 0.20 inch. Other materials can also be used including steel, titanium, aluminum and brass. The number of thin metallic straps can also vary within the scope of this invention to be consistent with the tension in the endless belt and the degree of bending required at the drive wheels. A gap distance G between each longitudinal portion a single thin metallic strap is provided so that the belt is flexible enough to be bent around a drive wheel. Gaps at the ends of thin metallic straps in one strap layer are spaced around the endless belt from gaps at the ends of thin metallic straps in an adjacent strap layer. Preferably, the gaps are placed adjacent to an attachment block between drive spheres. Thin metallic straps 45*a*–45*d* may be coated with a TEFLON® coating or a thin low friction strip can be placed between adjacent thin metallic strap layers to allow the straps to slide with respect to each other.

An endless carrier 40 is supported and carried by a rail assembly 20 over a length between inlet end 20*a* and outlet end 20*b* of the rail assembly (FIG. 2). Over a major portion of this length the endless carrier is supported and carried by a stretch or intermediate guideway (24*a* or 24*b*) of the rail assembly (herein called a typical guideway 24). A cross-section of the typical guideway is taken along line 5—5 in FIG. 2, as illustrated in FIG. 5. Typical guideway 24 is preferably made as upper and lower longitudinal rail sections 24*c* and 24*d* which are attached to one another to form a delivery or delivery pathway slot 28 and a return pathway slot 29. The delivery pathway slot supports and transports the endless carrier in a working relationship with the sheet material (FIG. 2) through a longitudinal side opening 28*a*. The return slot is to support and protect the endless carrier as it returns to the entry section of the rail assembly. Typical guideways 24 can be made of aluminum, steel or a brass/bronze alloy. Guideways can also be extruded in two parts using a high grade steel and fastened together by conventional fasteners. A alloy of aluminum, iron and copper is available as AMPCO-20 manufactured by Ampco Metals, Inc. of Milwaukee, Wis. This alloy can be used to form the guideways by extruding a guideway in two sections 24*c* and 24*d*. Bushings and raceways can also be extruded using this alloy. Preferably, guideways are made of a high strength aluminum alloy by machining the guideways in sections to provide both slots 28 and 29.

Contact between typical guideway 24 and bearing ball 30 of the attachment blocks link provides a running surface at vertically spaced forward engagement shoulders 27*a* and 27*b* of the guideway, as illustrated in FIG. 5. An view of the bearing ball 30 being extracted from the attachment block shows forces F on bearing ball 30 from shoulders of typical guideway 24 and a pressure P1 on the bearing ball from roller bushing 39. The materials of the bearing balls and the guideways are preferably selected so that the bearing balls will not slip when rolling along interface shoulders 27*a* and 27*b*. The result is a rotation of bearing balls 30 about a z-axis (FIG. 4), shown by an arrow Z, within delivery pathway slot 28. Roller bushing 39 is made of a low friction and low wear material so that sliding occurs between the bearing balls and the roller bushing when the endless carrier is being transported within the tentering pathway slot 28.

Contact between typical guideway 24 and the return portion of endless carrier 40 exists within return pathway slot 29. A return bushing 29*a* is imbedded in typical guideway 24 and the bearing ball(s) interfaces a return engagement interface shoulder 27*c* of the typical guideway. A view of a bearing ball 30' being extracted from attachment block 42' shows a pressure P2 on the bearing ball from interface shoulder 27*c*. As a result of this contact, the bearing ball 30' will rotate about a y-axis (FIG. 4), as shown by an arrow Y, within return pathway slot 29. Contoured drive elements 46 can also be made to contact the typical guideway within either or both pathway slots 28 and 29 by providing engagement interface shoulders as a part of the typical guideways. These shoulders will help support endless carrier 40 within guideways 20 and 20'. Contoured drive elements 46 can rotate about an axis of connecting pins 47 in the x-y plane for helping to support and carry the endless carrier within these pathway slots. Pathway slots 28 and/or 29 are generally provided in all guideways of the rail assemblies. The ability of an unrestrained bearing balls 30 and 30' (FIG. 5) to rotate about orthogonal axes is unique to this invention for endless carriers, as the references do not use bearing balls. The proper use of materials for the attachment blocks, the interface shoulders of the guideways and the bearing balls is critical for the proper movement of the endless carrier within the guideways, while controlling wear. The preferred movement is characterized by bearing balls 30 and 30' rolling along the interface shoulders without sliding. This movement helps control wear of the various structural components. The tentering system is further designed to have self lubricating contact between the guideways and the endless carriers to provide a non-lubricated tentering system so that the sheet material will not become contaminated. The use of self lubricating materials allows the tentering system to remain clean and not contaminate the sheet material.

A tradeoff exists between what materials are best to use for each component of the tentering system. The bearing balls can be made of steel, plastic or a ceramic material. Steel balls are usually chrome plated for improved wear. A typical graphite-plastic composite compound known in the industry to provide low wear components which require little lubrication is VESPEL®, as manufactured by Bunting Bearing Corporation of Toledo, Ohio. Bushings, raceways and other interfacing components of the attachment blocks can also be made using VESPEL®. In addition, extruded bushings, raceways and other components can also be made using the previously disclosed AMPCO-20 brass/bronze alloy material.

The bearing balls are for a heavy duty operation and must resist high loads that produce high rates of wear. Preferably, the bearing balls are of stainless steel having a diameter of about 1 inch to about 2.5 inches depending on the size and scope of the tenter machine.

Attachment blocks 42 can be made using a number of materials including steel, aluminum, a bronze/brass alloy, or a composite resin matrix material. Attachment blocks can be die cast or injection molded. Resin based composites are available for making component shapes by injection molding. A resin based product available under the name of TORLON® can be used in a high temperature and high wear environment. These TORLON® products are manufactured by Amco Chemicals Corporation of Chicago, Ill. Preferably, the attachment blocks are made by machining a block made from a high strength aluminum alloy material.

Alternate embodiments of the tentering system are disclosed in the following sections. Low-profile endless carriers and rail assemblies are common to all the embodiments. These low-profile systems are partially realized by using bearing assemblies to retain bearing balls within an attachment block for all embodiments of the endless carrier.

Figure 6:
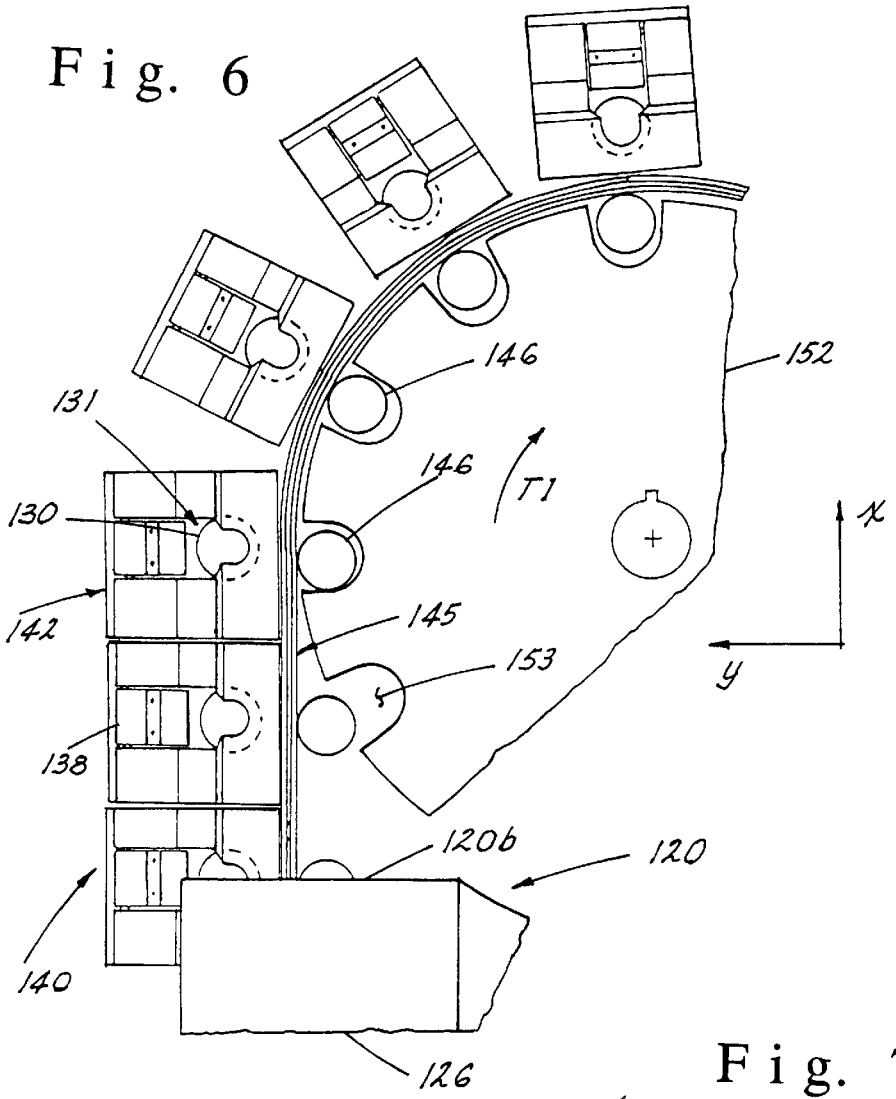
FIG. 6 is a plan view of another embodiment of a low-profile endless carrier and attachment blocks having a single bearing ball and drive sphere, as it leaves a delivery guideway to become engaged by a drive wheel of a tentering system of the invention.
Figure 7:
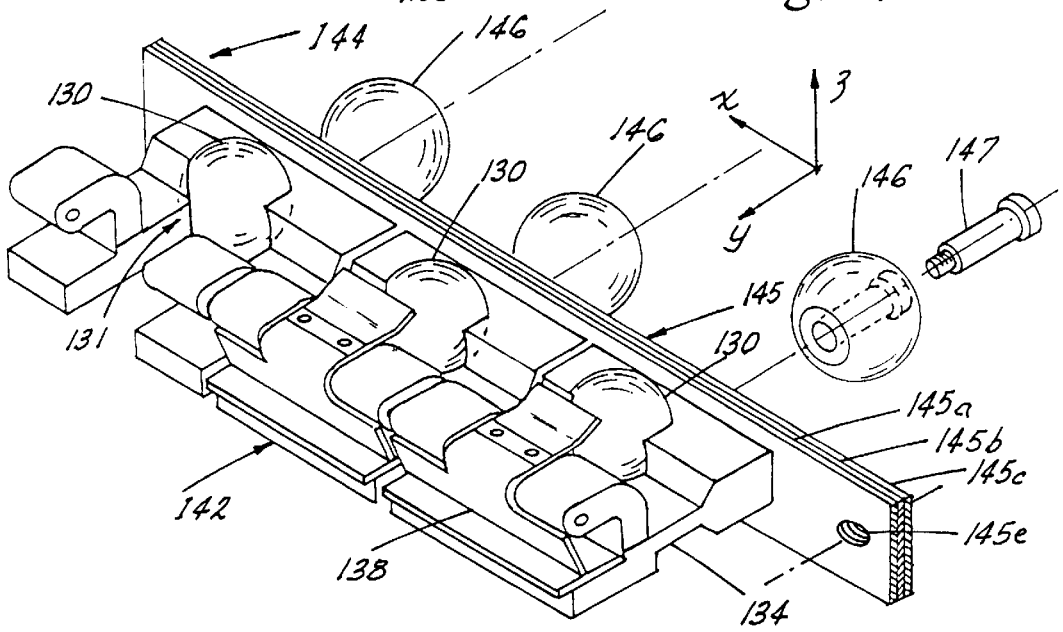
FIG. 7 is a perspective view of the attachment blocks and drive spheres connected to the longitudinal strap belt of the tentering system embodiment of FIG. 6.

In FIGS. 6 and 7, an endless carrier 140 is provided having a single bearing ball 130 in each low-profile attachment block 142. The bearing ball is again retained by a bearing assembly 131 of an attachment block 142 free to rotate about any spacial axis. The illustration of FIG. 6 is similar to that of FIG. 3 for endless carrier 40. Endless carrier 140 exits an outlet end 120*b* of a delivery guideway 126 of a rail assembly 120. A single contoured drive element or drive sphere 146 is associated with each attachment block 142. An endless belt 144 having a plurality of longitudinally extending straps 145 is again used to interconnect with attachment blocks 142 and drive spheres 146 to form endless carrier 140. The straps include three layers of thin metallic straps 145*a*, 145*b* and 145*c* forming endless belt 144. Each layer is again made with a plurality of thin straps end to end with a strap space or gap between each end interface (FIG. 4A). A drive sphere 146 is connected with a base portion 134 of attachment blocks 142 using a connecting pin 147 extending through slotted holes 145*e* aligned between strap layers. The drive spheres are free to rotate about the connecting pin to help transport endless belt 144 within the guideways of the rail assemblies.

The embodiment illustrated in FIGS. 6 and 7 has an endless carrier 140 with a tentering connector in the form of a tentering clip 138 included with each attachment block 142. Tentering clips provide an alternate means for gripping the selvedges of the sheet material 11 to transport the sheet material under tension along a longitudinal path (FIG. 2). A bearing assembly 131 having a bearing ball 130 is included with each attachment block for supporting the attachment blocks within guideways of rail assembly 120.

Low-profile attachment blocks are spaced in series on a first side of an endless belt 145. The endless belt has a plurality of longitudinal extending straps 145*a*–145*c* formed together in an overlapping manner to provide endless belt 144, as illustrated in FIG. 7. Attachment blocks 142 and drive spheres 146 are held together by a plurality of connecting pins 147. Each connecting pin extends through the drive sphere and further through longitudinal extending straps 145*a*–145*c* to connect with attachment block 142. The drive spheres are free to rotate about a y-axis of the xyz reference coordinate system. Bearing balls 130 are free to rotate about any axis as they support the attachment blocks within the guideways. As the attachment blocks exit an outlet end 120*b* of delivery guideway 126, spaced apart drive spheres 146 are positioned along a second side of the endless belt for engagement with sprocket cavities 153 in a drive wheel 152. A torque T1 supplied by the drive system (FIG. 2) to the drive wheel moves the endless carrier along its closed-loop path.

Figure 8:
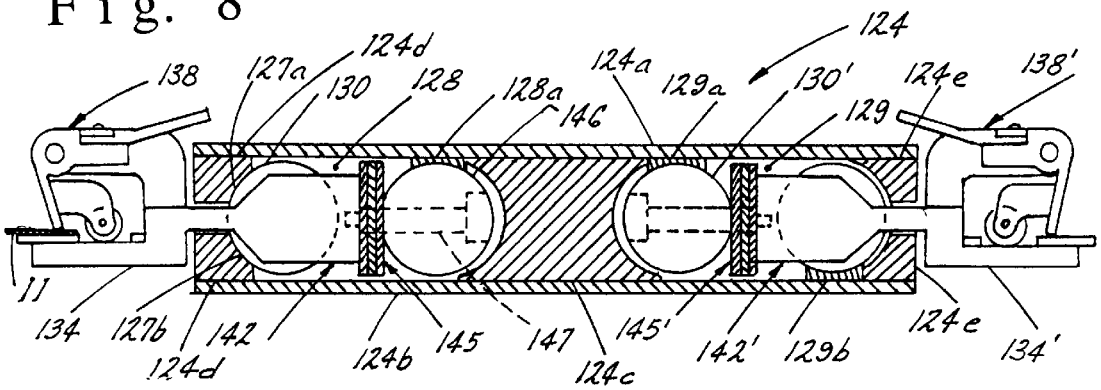
FIG. 8 is a cross-sectional view of an alternate guideway design for the rail assemblies showing an endless carrier being guided within a tentering or delivery pathway slot on one side of the guideway and guided by a return pathway slot on the other side of the guideway.

A guideway 124 for accommodating low-profile blocks 142 is shown in the cross-sectional view illustrated in FIG. 8. This design of guideway 124 is shown supporting the endless carrier of FIGS. 6 and 7. However, this low-profile guideway design may be used with any of the endless carrier embodiments within the scope of this invention. Guideway 124 includes a pair of longitudinally extending plates 124*a* and 124*b* vertically spaced apart by a plurality of raceways 124*c*–124*e*. The plates and raceways form a tentering pathway slot 128 and a return pathway slot 129. Tentering clips 138 and 138' carried by flanges 134 and 134' of attachment blocks 142 and 142' extend from the slots 128 and 129 respectively as the endless carrier 140 moves within guideway 124.

A first raceway 124*c* separates the two pathway slots 128 and 129 (FIG. 8). A pair of second raceways 124*d* include internal engagement shoulders 127*a* and 127*b* for engaging bearing balls 130 to allow the bearing balls to roll along the guideway while supporting the endless carrier within the guideway. Additional raceway bushings are also provided to help support the endless carrier within the tentering pathway slot 128 and the return pathway slot 129. A tentering bushing 128*a* provides engagement with drive sphere 146 so that the drive sphere can roll along the tentering bushing as the endless belt moves through the tentering pathway slot. A pair of bushings 129*a* and 129*b* are provided in the return pathway slot 129 to transport the endless carrier along its return path in the return pathway slot. Top bushing 129*a* provides for engagement with the drive sphere 146' and bottom bushing 129*b* provides engagement with the bearing ball for transporting the endless carrier through the return pathway slot. The same materials can be used for the raceways and bushings as discussed for the preferred embodiments previously disclosed. The materials can be self lubricating to provide a clean environment for sheet material 11 being transported.

Figure 8A:
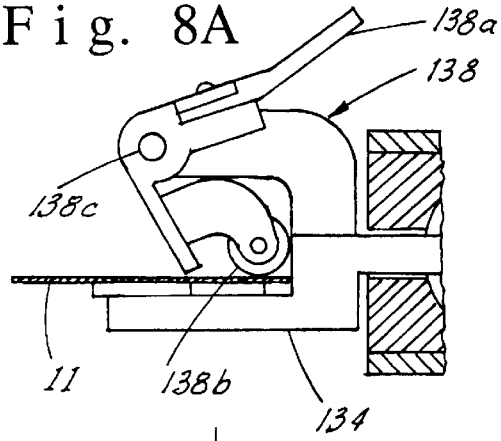
FIGS. 8A and 8B are side elevation views of a tentering clip of FIG. 7 showing the operation of the clip device in holding a sheet material.
Figure 8B:
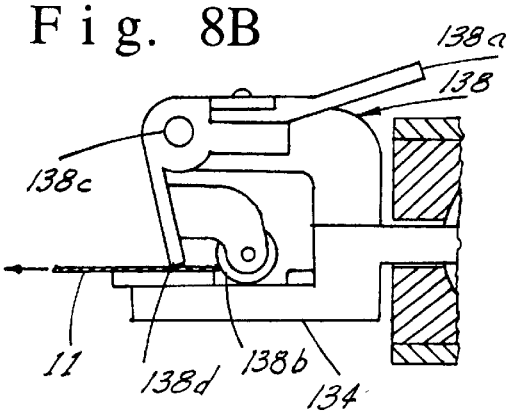

Tentering clips 138 are too large to be transported in a return pathway slot of a low-profile guideway. Details of the tentering clip 138 are illustrated in FIGS. 8A and 8B. The sheet material 11 is initially engaged with the tentering clip while a clip handle 138*a* along with a clip roller 138*b* pivot about a clip pin 138*c* to receive the sheet material. As the sheet material is placed in tension (see arrow), the clip roller drops into a clip slot 138*d*, clip handle 138*a* and clip roller 138*b* rotate and a clip edge 138*e* grabs the sheet material holding the sheet material attached to the tentering clip, as illustrated in FIG. 8B. The tentering clip of this invention has been designed to provide a low-profile tentering clip for use with a compact dryer oven or other compact tenter machine components (FIGS. 1 and 2).

Figure 9:
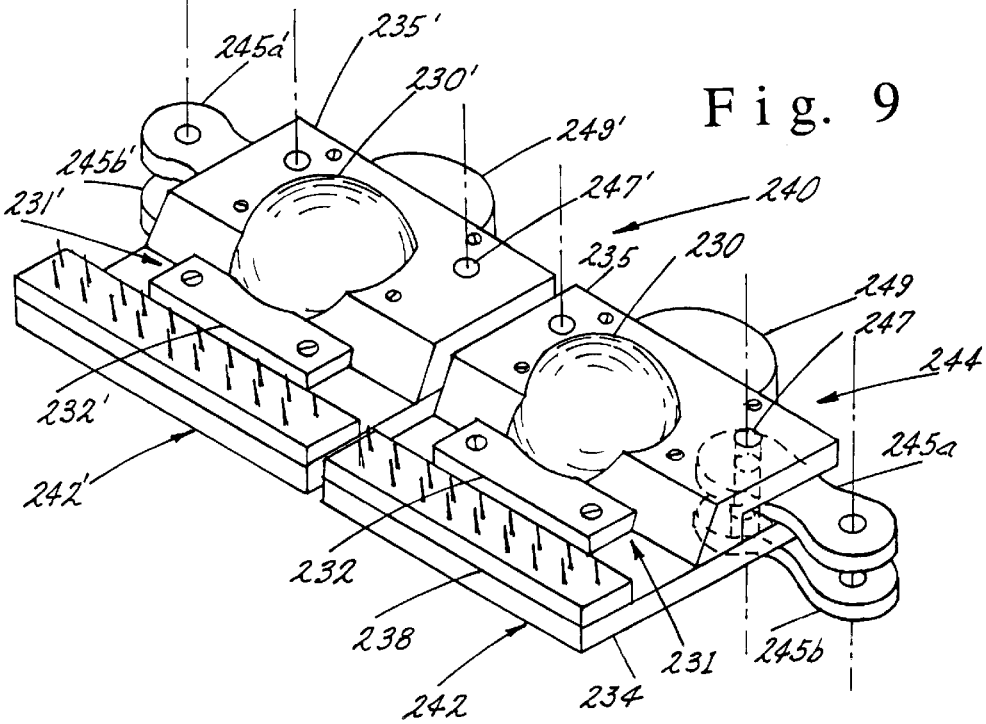
FIG. 9 is a perspective view of a further embodiment of the low-profile tentering system showing an alternate means for linking together attachment blocks and having drive flanges for interfacing with a drive wheel.

In the embodiment of FIG. 9, linking elements are used to connect attachment blocks together side by side to form an endless carrier. As illustrated, an endless carrier 240 is formed by linking elements 245*a* and 245*b* connecting attachment blocks 242 in series to form an endless chain belt 244. Each attachment block includes a base portion 234 and an upper portion 235. Linking elements 245*a* and 245*b* are rotatably attached to the base portion and the upper portion by connecting pins 247 to form endless carrier 240 in the form of endless chain belt 244. Both the base and upper portions have a spherically shaped cutout for retaining a bearing ball 230 for contacting engagement shoulders of a guideway, as previously disclosed (FIGS. 5 or 8). Bearing assemblies 231 and 231' each having a ball retainer 232 to help retain the bearing ball within the attachment blocks. A pin tenter 238 is shown attached to base portion 234. However, a tentering clip, or other tentering connector, can be use in place of the pin tenter with this or any other embodiment of an attachment block. The contoured drive elements of this embodiment takes the form of contoured drive flanges 249. The drive flanges are spaced apart for engaging sprocket cavities of a drive wheel so that the drive wheel drives endless carrier 240 along a closed-loop path (FIGS. 2 and 6). Any combination of contoured drive elements can be used within the scope of this invention to drive an endless carrier.

Figure 10:
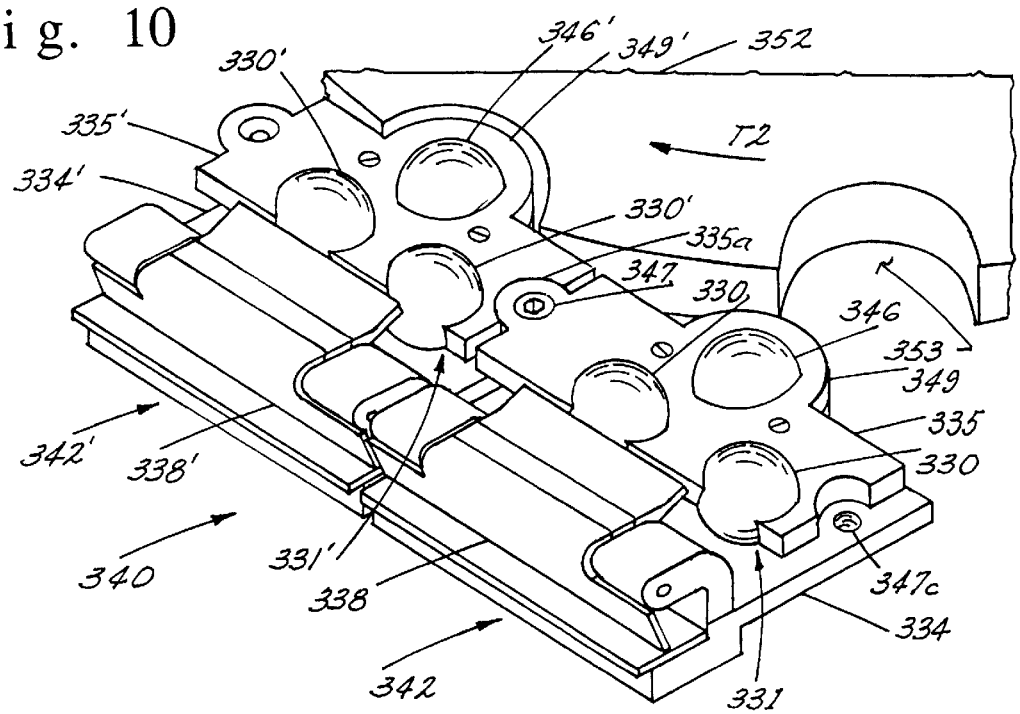
FIG. 10 is a perspective view of another embodiment of the low-profile endless chain of FIG. 9 with each attachment block having two spherical bearing balls and a single return bearing ball and drive flange that interfaces with a drive wheel.

As can best be seen in FIG. 10, an endless carrier 340 of this embodiment has a pair of bearing balls 330 carried by attachment blocks 342 and 342'. Each attachment block includes a base portion 334 and a linking element upper portion 335. A tentering clip 338 is affixed to the base portion 334 for holding the sheet material under tension. Both portions 334 and 335 have a spherically shaped cutout for retaining a pair of bearing balls 330 for contacting engagement shoulders of the guideways, as previously disclosed (FIGS. 5 or 8). The upper portion 335 forms a linking element to provide a link between adjacent attachment blocks. Connecting pins 347 connect a linking tab 335*a* of upper portion 335 of one attachment block 342 to a base portion 334' of adjacent attachment block 342'.

Endless carrier 340, as illustrated in FIG. 10, includes drive flanges 349, 349' having additional bearing balls 346, 346'. Each drive flange is made integral with the base and upper portions of a respective attachment block 342 or 342'. Drive flanges engage circumferentially arranged sprocket cavities 353 in a drive wheel 352 for moving the endless carrier through guideways when a torque T2 is applied to the drive wheels by a drive system (FIG. 2). Bearing balls 346 and 346' are free to rotate within drive flanges to help support endless carrier 340 within pathway slots of respective guideways.

Figure 11:
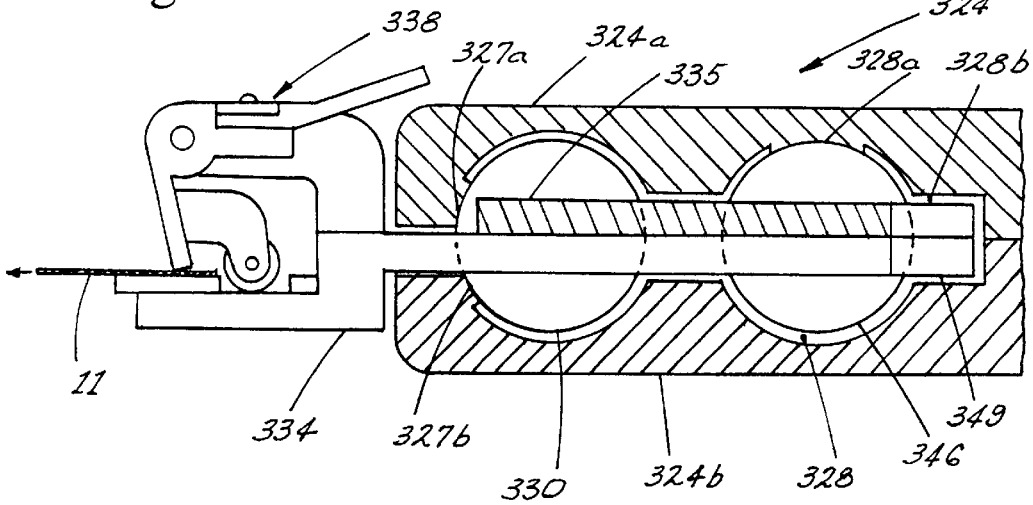
FIG. 11 is a cross-sectional view of a guideway supporting the endless carrier of FIG. 10.

A guideway 324 having an internal tentering pathway slot 328 to support the endless carrier 340 of FIG. 10 is illustrated in FIG. 11. A return pathway slot (not shown) is configured similar to the tentering pathway slot to provided a guideway similar to the two part guideway of FIG. 5. An upper guideway portion 324*a* combines with a lower guideway portion 324*b* to form the guideway having tentering guideway slot 328. A base portion 334 of each attachment block extends from the guideway to provide a means for attaching a tentering clip 338 to hold the sheet material 11 under tension. A pair of internal engagement shoulders 327*a* and 327*b* of the guideway engage bearing balls 330 for rotatably retaining the endless chain belt within the tentering pathway slot when tension is applied to sheet material 11. An upper engagement shoulder 328*a* of the tentering pathway slot rotatably retains the return bearing balls to help support and transport the endless carrier as it moves within the tentering pathway slot. A drive flange cutout 328*b* is also provided to allow space for drive flanges 349 within tentering pathway slot 328 of guideway 324.

An essential feature of the rail assemblies of this invention is the means provided for connecting the various guideways together. The illustration of FIGS. 1 and 2 shows various sections 12, 14, 16 and 18 of each rail assembly 20 and 20'. The stretch section 14 results in the endless carrier moving through an acute angle along its x-direction longitudinal path with respect to the entry and intermediate sections of the rail assemblies. The straight guideways 24*a* and 24*b* are have cross-sections typical of the cross-sectional views of the typical guideways 24 illustrated in FIGS. 5 and 8, or guideway 324 of FIG. 11. Entry guideways 22*a* and delivery guideways 26*a* have tentering pathway slots and return pathway slots which are laterally spaced apart to direct the endless carrier to encircle the drive wheels 55 and 52 respectively. Transition guideway sections or connecting guideways 21, 23 and 25 are provided to provide a smooth travel of the endless carrier in the closed-loop path to include longitudinal path.

Figure 12:
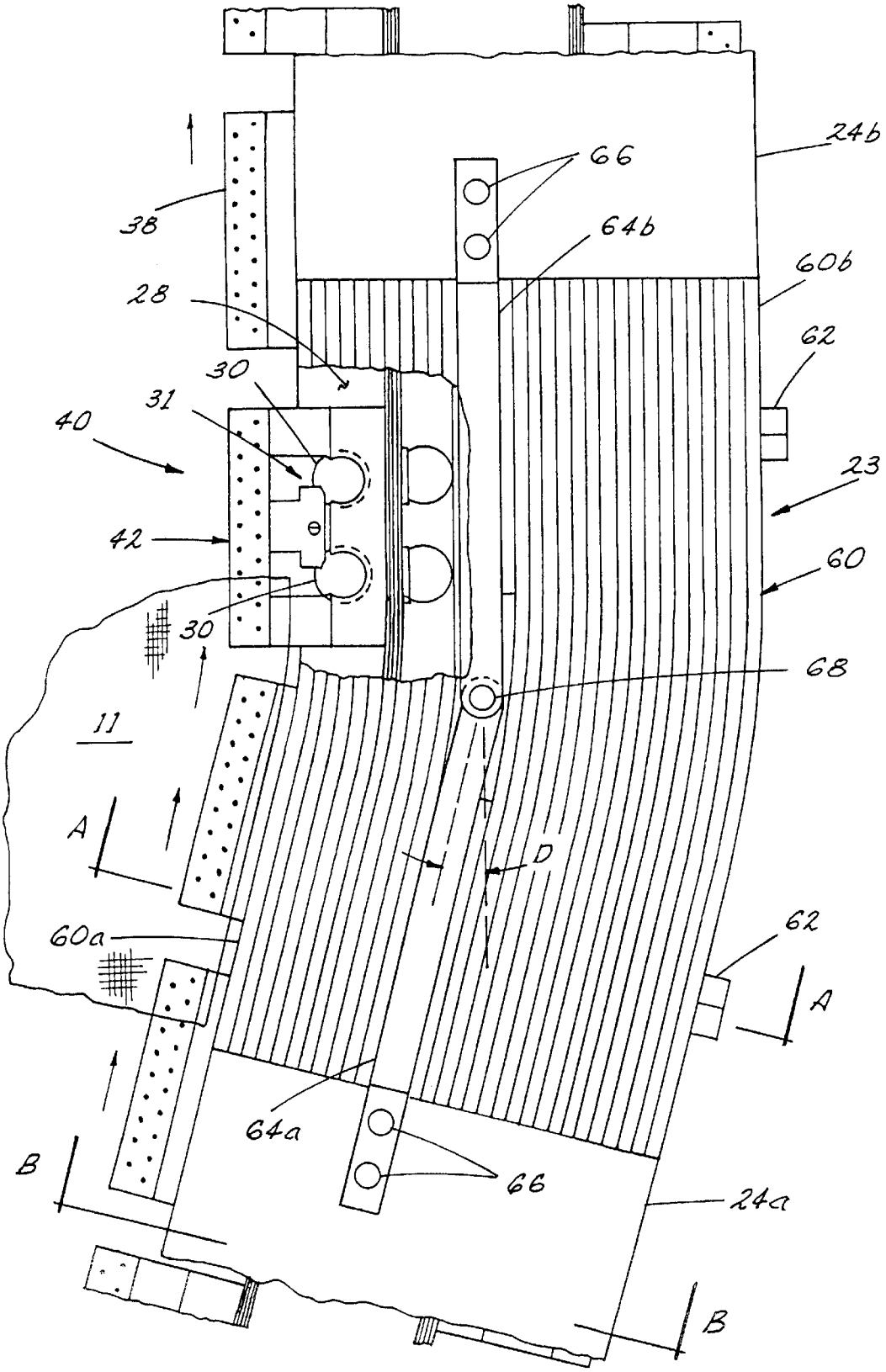
FIG. 12 is a plan view of a transition guideway section of a rail assembly for transitioning other rail guideways together and for deflecting attachment blocks horizontally along their path through a smooth deflection angle within a tentering pathway slot.
Figure 13A:
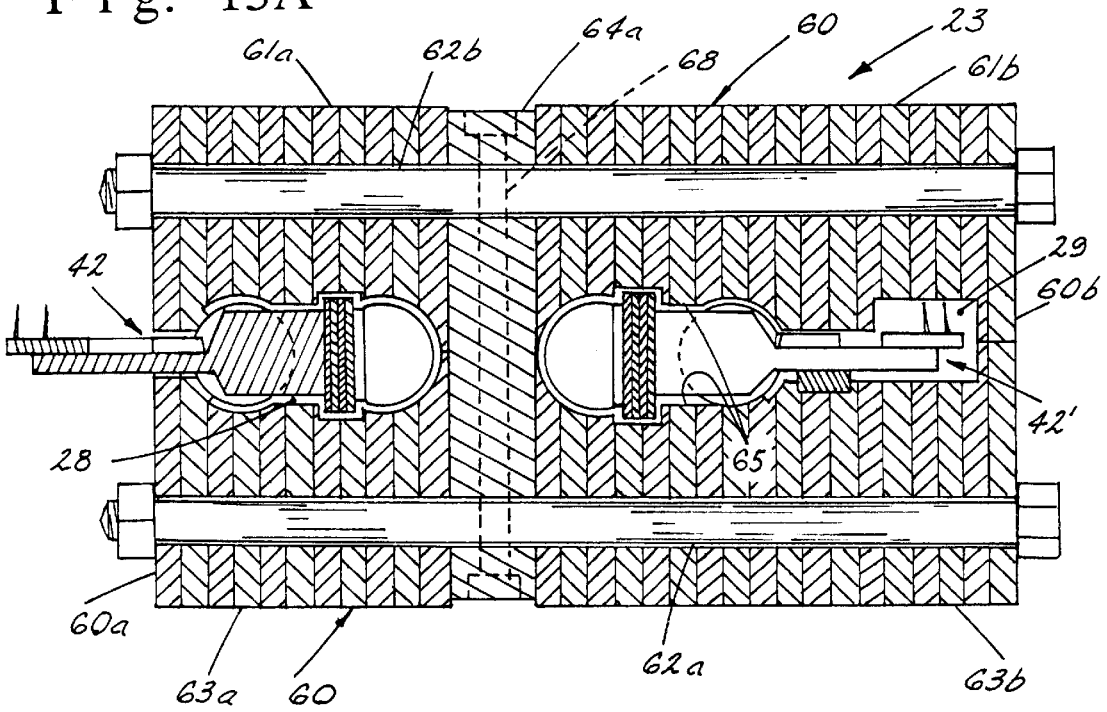
FIG. 13A is a cross-sectional view of the transition guideway section of FIG. 12 taken along line A—A showing a plurality of bending contour plates and a guideway connector bar for forming the transition guideway section.
Figure 13B:
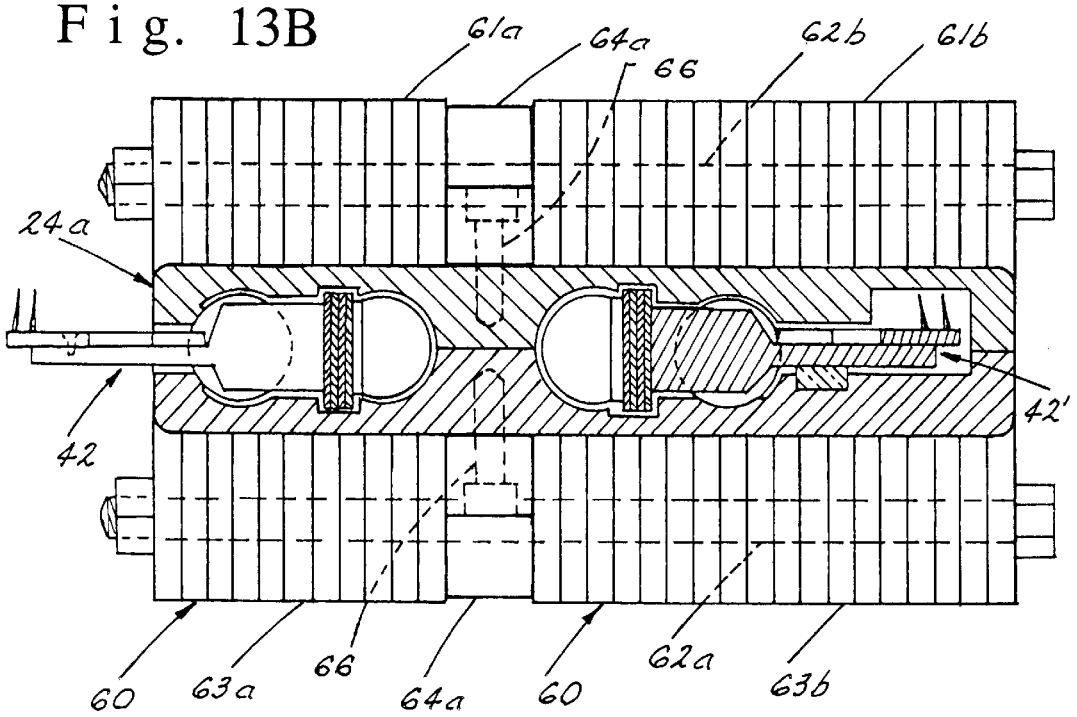
FIG. 13B is a cross-sectional view of a connecting guideway taken along line B—B in FIG. 12 showing the transition guideway section joined to an adjacent guideway with connector bar fasteners through the connector bar.

Further details of the transition guideway sections 21, 23 and 25 of a rail assembly 20 or 20' are shown by referring to the illustrations of FIGS. 12, 13A and 13B for a typical transition guideway section 23. The other transition guideway sections 21 and 25 are constructed to be similar to this typical transition guideway section. In FIG. 12, a top view of transition guideway section 23 for attaching a stretch guideway 24*a* and an intermediate guideway 24*b* is illustrated. The longitudinal path of the endless carrier 40 changes through an angle D as it is being carried and guided an by the transition guideway section. A cut-away section of the transition guideway section of FIG. 12 shows an attachment block 42 of the endless carrier having been rotated through the angle D by traveling within the transition guideway section in a direction shown by the arrows. The attachment block extends to the exterior of the transition guideway section for supporting a pin tenter 38 to carry sheet material 11.

A cross-sectional view taken along line A—A in FIG. 12 is shown in FIG. 13A. A plurality of bending contour plates 60 having their surfaces vertically disposed, are stacked together to form the two lateral sides 60*a* and 60*b* of the transition guideway section 23. Plates 60 have a gradually curved surface for bending through angle D. Guideway connector bars 64*a* and 64*b* form a longitudinal core of the transition guideway section for attachment to the adjacent guideways 24*a* and 24*b*. The connector bars are pinned together in the center of guidewauy section 23 with a guideway connector pin 68; to be removed when taking the rail assemblies 20 and 20' apart (FIG. 1).

A plurality of plate connector pins 62 of the transition guideway section 23 hold adjacent plates 60 and connector bars 64 together to form a rigid transition guideway section, as illustrated in FIG. 13A. A delivery pathway slot 28 and a return pathway slot 29 are formed within the transition guideway section by opposing horizontal edges 65 of each plate. Pathway slots are formed by each of the adjacent plates 60 having a top portion 61 and a bottom portion 63 on each lateral side of the guideway connector bars 64*a* or 64*b*. Top portions 61*a* and 61*b* of the adjacent plates are held attached to the guideway connector bar 64*a* or 64*b* by plurality of top plate connector pins 62*b*. Bottom portions 63*a* and 63*b* of the bending contour plates are held attached to the guideway connector bar 64*a* or 64*b* by a plurality of bottom plate connector pins 62*a*. The pathway slots 28 and 29 are formed by opposing horizontal edges of the adjacent plates to have the same shape as the slots in the remaining guideways. The general shape of the slots are determined by the endless carrier embodiment used. For example, general pathway slot features were previously disclosed for supporting endless carrier 40 in typical guideway 24 (see FIG. 5).

Means for attaching of transition guideway section 23 to a stretch guideway 24*a* is illustrated in FIG. 13B by the cross-sectional view taken along line B—B in FIG. 12. The guideway connector bar 64*a* is extended to provide a lapping arrangement with the stretch guideway (also see FIG. 12). Connector bar fasteners 66 are used for affixing transition guideway section 23 with stretch guideway 24*a*. This means for attaching guideway sections together is typical.

Materials used for making the bending contour plates 60 and the guideway connector bars 64*a* and 64*b* of the transition guideway sections 21,23 and 25 include steel and aluminum. Standard steel or aluminum alloy pins and fasteners are also used. The preferred material is aluminum. The adjacent plates and the guideway connector bar of the transition guideway sections can be replaced by machining steel or aluminum blocks to have the same shape as the combination of contoured plates and the bar.

The tentering system of FIGS. 1, 2, 3, 6 and 10 illustrate drive wheels 52 and 55 which are rotating in a horizontal plane about a vertical axis. The endless carrier is transported in a horizontal plane around the drive wheels. Other orientations of the drive wheels and corresponding endless carriers used with these drive wheels are illustrated in FIGS. 14 and 15. A vertical tentering system 410 characterized by vertically disposed drive wheels 452 is illustrated in FIG. 14. The vertical drive wheel rotates about a horizontal H-axis parallel to the y-axis (FIG. 2).

The endless carrier 440 is provided to work best with vertical drive wheel 452. A cross-sectional view of the endless carrier taken along line C—C in FIG. 14 is illustrated in FIG. 14A. The endless carrier includes a flexible molded belt portion 444 having belt reinforcements 446. The molded belt portion carries pin tenters 438 along their longitudinal path and contains spaced apart bearing balls 430 free to rotate within spherically shaped cutouts of the molded belt portion. The belt portion can be made of a plastic or rubber material which deforms but retains its tensile strength by the belt reinforcement. The belt reinforcement is preferably made of high strength metallic wire cables or manufactured fibers typical of those used as standard tire reinforcement. An endless flexible metallic strap 445 is attached to the molded belt portion for adding strength to the molded belt portion for retaining the spaced apart bearing balls 430 within molded belt portion 444. Contoured sprocket cavities 453 are formed in an outer surface 452*a* of the vertical drive wheel for receiving the bearing balls. A torque T3 is applied to vertical drive wheels to move the endless carrier along its closed-loop path.

Guideways of the rail assemblies (not shown) used with this tentering embodiment of FIG. 14 have pathway slots similar to those previously shown and discussed, but formed and sized to accommodate the present endless carrier 440. Once again, the pathway slots allow the endless carrier to carry the sheet material along its longitudinal path and return.

Another vertical tentering system 510 having vertically disposed drive wheels is illustrated in FIG. 15. Vertical drive wheels 552 are similar to those used with the previous embodiment, having a rotation about a horizontal H-axis and contoured sprocket cavities 553 for driving the endless carrier 540. The endless carrier of this embodiment includes a series of attachment blocks 542 connected by linking elements 545 to form an endless chain belt 544 of the endless carrier. A base portion 543 and an upper portion 535 of each attachment block have spherically shaped cutouts for retaining a bearing ball 530 free to rotate within a respective attachment block. The base portions carry pin tenters 538 along their longitudinal path. Contoured sprocket cavities 553 receive the bearing balls. A torque T4 is applied to the vertical drive wheels 552 to move the endless carrier 540 along its closed-loop path.

Guideways of the rail assemblies (not shown) used with vertical tentering system 510 of FIG. 15 have pathway slots similar to those previously shown and discussed. Slots are formed and sized to accommodate the present endless carrier 540. Once again, the pathway slots allow the endless carrier to carry the sheet material along its longitudinal path and return.

Thus, it can be seen that a highly advantageous construction for a low-profile tenter system is can be had according to the invention. The rail assemblies provide a low-profile design including guideways fabricated to include pathway slots having low friction and/or self lubricating roller bushings or raceways for smooth and clean transporting of the endless carrier within the guideways. Pathway slots are provided for both the delivery portion of the endless carrier path and the return portion of the path. A delivery slot includes a pair of vertically spaced apart engagement shoulders. The tentering engagement shoulders provide a smooth running surface for the bearing ball within the guideways. Transition guideways are each formed with a plurality of bending contour plates to provide for smooth angular transitions when connecting together entry, stretch, intermediate and delivery guideways of rail assemblies. The transition guideway sections have slots for providing for a smooth change in the direction of the longitudinal path formed by adjacent guideways.

While a preferred embodiment of the invention has been described using specific terms, such description is for illustrative purposes only, and it is to be understood that changes and variations may be made without departing from the spirit or scope of the following claims.

What is claimed is:

1. A tentering system for transporting sheet material under tension in an open width condition along a longitudinal path comprising;

spaced rail assemblies supported on opposing sides of said longitudinal path;

an endless carrier carried by each said rail assembly for conveying said sheet material along said longitudinal path;

said rail assemblies having guideways for carrying said endless carrier along said longitudinal path;

a plurality of low-profile attachment blocks included in said endless carrier for holding spaced edges of said sheet material under tension;

spaced drive wheels associated with said rail assemblies for moving said endless carrier along a closed-loop path which includes said longitudinal path; and bearing assemblies included in said low-profile attachment blocks having at least one bearing ball being operative to engage said guideways to allow said endless carrier to move along said guideways in a controlled, guided and substantially restraint-free manner.

2. The system of claim 1 wherein said guideways include internal engagement shoulders, and said bearing assemblies of said attachment blocks have a ball retainer rotatably retaining said bearing ball as said bearing ball engages said engagement shoulders.

3. The system of claim 2 wherein said bearing assemblies include a roller bushing carried within said attachment blocks for engaging said bearing ball along a side opposite said shoulder engagement for holding said bearing ball in said engaged relationship with said engagement shoulders when said sheet material is under tension.

4. The system of claim 2 wherein guideways include pathway slots receiving said bearing assemblies, said pathway slots having longitudinal side openings, said engagement shoulders being defined on opposing sides of said side opening, and a flange of said attachment blocks extends through said side opening between said engagement shoulders to support said tentering connector near a free end thereof.

5. The system of claim 1 wherein said guideways comprise a delivery pathway slot and a return pathway slot by which said bearing balls are guided, so that said endless carrier is guided along said longitudinal path.

6. The system of claim 5 wherein said delivery pathway slot includes a pair of vertically spaced forward engagement shoulders, said engagement shoulders providing a running surface for said bearing balls of opposing endless carriers during transport of said sheet material in said open width tension along said longitudinal path.

7. The system of claim 6 wherein said delivery pathway slot includes a rear engagement shoulder spaced rearwardly from said forward engagement shoulders providing a top running surface which interfaces with said endless carrier during transport of said sheet material to help maintain said sheet material in said open width condition along said longitudinal path.

8. The system of claim 7 including a return bushing carried in said return pathway slot for contacting said endless carrier to further position and support said endless carrier within said return pathway slot.

9. The system of claim 6 wherein said return pathway slot includes a return engagement shoulder for engaging said bearing ball to help position said endless carrier within said return pathway slot, and said return shoulder providing a running surface for said bearing balls which vertically supports said endless carrier.

10. The system of claim 1 wherein said guideways include an upper longitudinal rail section and a lower longitudinal rail section joined together to form an internal pathway slot for guiding said endless carrier, and upper and lower interface shoulders formed in said pathway slot engaged by said bearing ball of said bearing assembly.

11. The system of claim 10 including a plurality of transition guideway sections for interconnecting adjacent ones of said guideways at desired junctions along said longitudinal path to provide for a change in the direction of the longitudinal path formed by said adjacent guideways.

12. The system of claim 11 wherein said transition sections include a series of adjacent bending contoured plates fastened together, and said plates having contours which correspond to said change of direction, wherein said plates form a flexible contour which can be either convex or concave for transposing lateral stretch forces along slevedges of said sheet material over a longer length of said sheet material than a length for a conventional transition section so that said stretch forces reduce a potential for damage to said sheet material within said transition sections.

13. The system of claim 12 wherein said series of plates are fastened together in a juxtaposed arrangement having horizontal edges vertically spaced apart to define said pathway slots therethrough.

14. The system of claim 1 wherein said spaced drive wheels are vertically disposed to rotate about a horizontal axis for transporting said endless carrier along its closed-loop path through said guideways.

15. The system of claim 14 wherein said endless carrier includes a molded belt portion and a flexible metallic strap for retaining said bearing balls to engage contoured sprocket cavities of said drive wheels for driving said endless carrier.

16. The system of claim 1 wherein said endless carrier includes a plurality of longitudinal straps secured together in a laminated overlapping manner to form an endless strap belt, said attachment blocks being carried by said endless belt and flanges projecting outwardly from said attachment blocks for carrying tentering connectors which hold spaced edges of said sheet material under tension.

17. The system of claim 16 wherein said strap belt carries a series of said attachment blocks on one side and a series of driving elements on an opposite side of said strap belt, said driving elements engaging said spaced drive wheels.

18. The system of claim 17 wherein said spaced drive wheels have circumferentially arranged sprocket cavities, and said drive elements include a plurality of contoured drive elements are arranged along said endless carrier in spaced apart positions to engage said sprocket cavities to drive said drive wheels.

19. The system of claim 18 including connecting members for rotatably affixing said drive elements to a first side of said endless belt and for securing said attachment blocks to a second side of said endless belt.

20. The system of claim 19 wherein said connecting members include:

roller bushings carried within said attachment blocks for holding said bearing ball adjacent said second side of said endless belt;

connector pins for connecting said drive elements on said first side of said endless belt with said roller bushings through said endless belt.

21. The system of claim 16 including strap spaces formed between said laminated overlapping straps to provide flexibility to said strap belt when it bends.

22. The system of claim 21 including connector members securing said straps together, and said longitudinal straps including oversized slotted holes which are partially aligned from strap to strap receiving said connector members so that said straps are slidably held together in their longitudinal direction to form said flexible endless belt, wherein said endless belt has the flexibility to bend in a plane perpendicular to said longitudinal direction.

23. The system of claim 22 wherein said connector member commonly connects said attachment blocks to one side of said belt and said drive elements to an opposing side of said belt.

24. The system of claim 1 including a plurality of linking elements connecting said attachment blocks together to form an endless chain belt, and said attachment blocks include an outwardly projecting flange carrying a tentering connector for engaging spaced edges of said sheet material under tension.

25. The system of claim 24 wherein said attachment blocks include linking tabs, and connecting pins connecting said linking tabs of adjacent attachment blocks for forming said endless chain belt.

26. The system of claim 25 wherein said attachment blocks include:

a base portion having a spherically shaped cutout for retaining said bearing ball;

an upper portion also having a spherically shaped cutout for retaining said bearing ball in a position to support said each attachment block within said guideways; and said linking tabs being carried by said upper and lower block portions.

27. The system of claim 26 wherein said linking tabs of adjacent attachment blocks overlap one another to form rotating joints of said endless chain belt.

28. The system of claim 24 wherein said drive wheels include contoured sprocket cavities and said each attachment block includes a contoured drive flange for engaging said cavities so that said drive wheels drive said endless chain belt.

29. The system of claim 1 wherein said attachment blocks include:

a generally spherically shaped ball retainer formed in said base portion to retain said bearing ball within said attachment block; and an outwardly projecting flange for mounting a tentering connector for engaging and retaining spaced edges of said sheet material under tension.

30. The system of claim 29 including a plurality of bearing balls retained in said ball retainer of said attachment blocks.

31. A tenter frame for transporting sheet material under tension in an open width condition along a longitudinal path of travel, said tenter frame comprising a pair of elongated rail assemblies extending along opposite sides of said longitudinal path, and said rail assemblies including longitudinal guideways having an entry end and an outlet end;

a plurality of drive wheels arranged at opposite ends of said rail assemblies with at least one of said drive wheels associated with each rail assembly being driven;

an endless carrier supported for longitudinal movement by said guideways of each of said rail assemblies, said endless carrier including a plurality of tentering connectors extending outwardly from said guideways for engaging with and carrying said sheet material under tension;

a plurality of attachment blocks included in said endless carrier arranged along one side of said carrier in side-by-side relationship, said attachment blocks being carried within said guideways of said rail assemblies from said entry end to said outlet end along said path of travel of said sheet material, each said attachment block carrying a one of said plurality of tentering connectors;

a plurality of drive spheres of said endless carrier arranged along an opposite side of said carrier in a equally spaced relationship along the length thereof; and said drive spheres being adapted to mate with said drive wheels so that rotating said drive wheels moves attachment blocks of said endless carrier through said guideways in a continuous closed-loop path for transporting said sheet material.

32. The tenter frame of claim 31 wherein said endless carrier includes:

a plurality of overlapping longitudinally extending straps laminated to form a flexible endless belt; and connecting members for rotatably positioning said drive spheres to a first side of said endless belt and for positioning said attachment blocks adjacent to a second side of said endless belt so that said straps are slidably held together in their longitudinal direction to form said flexible endless belt, wherein said endless belt has the flexibility to bend in a plane perpendicular to said longitudinal direction.

33. The tenter frame of claim 31 wherein said endless carrier includes a plurality of linking elements connecting said attachment blocks together to form an endless chain.

34. The tenter frame of claim 33 wherein each one of said attachment blocks includes:

a base portion having a spherically shaped cutout for helping to retain said bearing ball and a tentering flange for attaching one of said tentering clip and said pin tenter;

an upper portion also having a spherically shaped cutout for helping retain said bearing ball; and connecting pins for attaching said linking elements to said base and upper portions of said attachment blocks for forming said endless chain.

35. The tenter frame of claim 31 wherein said guideways include internal engagement shoulders, and attachment blocks have a ball retainer rotatably retaining said bearing ball as said bearing ball engages said engagement shoulders.

36. The tenter frame of claim 35 including a base portion of said attachment blocks associated with said ball retainers, said base portion having:

a spherically shaped cutout for helping said ball retainer to retain said bearing ball within said attachment block; and a flange for mounting one of said tentering clip and said pin tenter.

37. The tenter frame of claim 32 wherein said attachment blocks are made from an aluminum alloy block by machining said block to form said attachment blocks, said bearing balls and said drive spheres are made of a high strength steel material having a chrome plating and said longitudinal extending straps are made from a thin metallic sheet of spring steel material.

38. The tenter frame of claim 32 wherein said attachment blocks are made by injecting a TORLON® material into a mold, said bearing balls are made of a ceramic material and said longitudinal extending straps are made from a thin metallic sheet of spring steel material having a TEFLON® coating.

39. A tenter frame for transporting sheet material under tension in an open width condition along a longitudinal path of travel, said tenter frame comprising:

a pair of low-profile rail assemblies extending longitudinally along opposite sides of said longitudinal path, each rail assembly including longitudinal guideways;

a delivery pathway slot formed in said guideways; and a return pathway slot formed in said guideways adjacent said delivery pathway slot;

an endless carrier supported by bearing balls in contact with said guideways for longitudinal movement within said delivery and return pathway slots of said guideways;

a tenter drive for driving said endless carrier in a closed-loop path which includes said delivery pathway slot and said return pathway slot, and said endless carrier being driven in opposite directions in said delivery slot and return slot; and a plurality of low-profile attachment blocks arranged along one side of said endless carrier in side-by-side relationship, said attachment blocks being carried within said delivery and return pathway slots of said guideways, said attachment blocks carrying tentering connectors for engaging with and transporting said sheet material along said longitudinal path when travelling through said delivery slot.

40. The tenter frame of claim 39 including a series of drive elements carried along an opposite side of said endless carrier from said attachment blocks along the length thereof;

said tenter drive including at least one drive wheel associated with said endless carriers; and said drive elements being adapted to mate with said drive wheel so that rotating said drive wheel moves said endless carrier through said slots of said guideways.

41. The system of claim 39 wherein said attachment blocks include at least one bearing ball that rotates omnidirectionally, and said delivery pathway slot includes a pair of vertically spaced forward engagement shoulders, said tentering shoulders providing a running surface which interfaces with said bearing ball and spaces said endless carriers laterally during transport of sheet material in open width condition.

42. The system of claim 41 wherein said return pathway slot includes at least one return engagement bushing for contacting said bearing ball and position said endless carrier within said return pathway slot.

43. The system of claim 41 wherein said tentering pathway slot includes a rear engagement shoulder spaced from said forward shoulder, said rear shoulder providing a top running surface guide said sheet material in said open width condition along said longitudinal path.

44. The system of claim 39 including transition sections between adjacent guideways of said rail assemblies, and said transition sections including a series of juxtaposed plates having opposing edges vertically spaced apart by a plurality of raceways for forming said guideways.

45. The system of claim 39 including a plurality of transition guideway sections for horizontally spacing each one of said guideways at a desired location along said longitudinal path and to provide for a change in the direction of the tentering and return pathway slots caused by adjacent guideways forming an angle with respect to each other.

46. The system of claim 39 including a plurality of transition guideway sections for interconnecting adjacent ones of said guideways at desired junctions along said longitudinal path to provide for a change in the direction of the longitudinal path formed by said adjacent guideways.

47. The system of claim 46 wherein said transition sections include a series of adjacent plates fastened together, and said plates having bends which correspond to said change of direction.

48. The system of claim 47 wherein said series of plates are fastened together in a juxtaposed arrangement having horizontal edges vertically spaced apart to define said pathway slots therethrough.

49. The tenter frame of claim 39 wherein said guideways are made in two rail parts using a high strength alloy material with said pathway slots machined within each part.

50. The tenter frame of claim 49 wherein said rail parts include a top rail plate and a bottom rail plate, and a plurality of raceways positioned between said plates for forming said pathway slots, said raceways being formed by extrusions using a bushing material.

51. In a tentering system for transporting sheet material under tension in an open width condition along a longitudinal path, tenter attachment blocks for engaging spaced edges of said sheet material and spaced rail assemblies for carrying said tenter attachment blocks along said longitudinal path, the improvement comprising:

low-profile rail assemblies extending longitudinally on opposing sides of said longitudinal path;

internal guideways formed in said low-profile rail assemblies;

low-profile attachment blocks slidably carried in said guideways which support an endless carrier securing opposing edges of said sheet material;

at least one bearing ball carried by each said attachment block for omnidirectional motion within said guideways; and a tenter drive for moving said attachment blocks and sheet material along said longitudinal path while supported by said ball bearings in said guideways.

52. The system of claim 51 including a plurality of transition guideway sections for interconnecting adjacent ones of said guideways at desired junctions along said longitudinal path to provide for a change in the direction of the longitudinal path formed by said adjacent guideways.

53. The system of claim 52 wherein said transition sections include a series of adjacent plates fastened together, and said plates having bends which correspond to said change of direction; and said series of plates are fastened together in a juxtaposed arrangement having horizontal edges vertically spaced apart to define said pathway slots therethrough.

* * * * *